US008251147B2

(12) United States Patent
Mondelli et al.

(10) Patent No.: US 8,251,147 B2
(45) Date of Patent: Aug. 28, 2012

(54) METHOD AND APPARATUS FOR CONTINUOUSLY INJECTING FLUID IN A WELLBORE WHILE MAINTAINING SAFETY VALVE OPERATION

(75) Inventors: Maximiliano Mondelli, Houston, TX (US); Jeffrey L. Bolding, Kilgore, TX (US); Don Sanders, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 531 days.

(21) Appl. No.: 12/500,688

(22) Filed: Jul. 10, 2009

(65) Prior Publication Data

US 2009/0277643 A1 Nov. 12, 2009

Related U.S. Application Data

(63) Continuation-in-part of application No. 11/916,966, filed as application No. PCT/US2006/022264 on Jun. 8, 2006, now Pat. No. 7,712,537.

(60) Provisional application No. 60/595,138, filed on Jun. 8, 2005.

(51) Int. Cl.
*E21B 43/00* (2006.01)

(52) U.S. Cl. ..... 166/319; 166/266

(58) Field of Classification Search ..... 166/316, 166/319, 305.1, 378

See application file for complete search history.

(56) References Cited

U.S. PATENT DOCUMENTS

| | | | |
|---|---|---|---|
| 3,827,501 | A | 8/1974 | Johnson et al. |
| 3,830,297 | A | 8/1974 | Cockrell et al. |
| 4,022,273 | A | 5/1977 | Marathe |
| 4,454,913 | A | 6/1984 | Guidry et al. |
| 4,842,074 | A | 6/1989 | Hines et al. |
| 2004/0045723 | A1 | 3/2004 | Slup et al. |
| 2007/0039740 | A1 | 2/2007 | Bolding |
| 2008/0164035 | A1 | 7/2008 | Bolding et al. |
| 2008/0169097 | A1 | 7/2008 | Bolding et al. |

(Continued)

FOREIGN PATENT DOCUMENTS

| | | |
|---|---|---|
| EP | 1828537 | 9/2007 |

(Continued)

OTHER PUBLICATIONS

EP Search Report from related EP Application No. 06772529.1 dated Jan. 13, 2011.

(Continued)

*Primary Examiner* — Kenneth L Thompson
*Assistant Examiner* — Yong-Suk (Philip) Ro
(74) *Attorney, Agent, or Firm* — Parsons Behle & Latimer

(57) ABSTRACT

The present disclosure is directed to a wellbore injection system. The wellbore injection system comprises a capillary fluid flow path positioned in a subsurface wellbore so as to allow fluid communication through the wellbore, the wellbore having a wellbore pressure. A receptacle is in fluid communication with a second fluid flow path that is positioned below the capillary fluid flow path in the wellbore. An injector is attached to a distal end of the capillary fluid flow path, the injector comprising an injector flow path. The injector is capable of being removably attached to the receptacle to provide fluid communication between the capillary fluid flow path and the second fluid flow path through the injector flow path. An isolation mechanism is capable of isolating the capillary fluid flow path from the wellbore pressure when the injector is not attached to the receptacle.

36 Claims, 23 Drawing Sheets

U.S. PATENT DOCUMENTS

| | | | | |
|---|---|---|---|---|
| 2008/0169106 | A1 | 7/2008 | Hill et al. | |
| 2008/0202770 | A1 | 8/2008 | Bolding et al. | |
| 2008/0210438 | A1 | 9/2008 | Bolding et al. | |
| 2008/0230231 | A1 | 9/2008 | Bolding et al. | |
| 2008/0271893 | A1 | 11/2008 | Hill et al. | |
| 2008/0277119 | A1 * | 11/2008 | Hill, Jr. et al. | 166/305.1 |

FOREIGN PATENT DOCUMENTS

| | | |
|---|---|---|
| WO | W02005/045183 | 5/2005 |
| WO | W02006/041811 | 4/2006 |

OTHER PUBLICATIONS

International Search Report dated Feb. 25, 2008 from related application No. PCT/US06/22264.

Written Opinion of the International Searching Authority dated Apr. 7, 2008, from related application No. PCT/US06/22264.

* cited by examiner

METHOD AND APPARATUS FOR CONTINUOUSLY INJECTING FLUID IN A WELLBORE WHILE MAINTAINING SAFETY VALVE OPERATION

CROSS-REFERENCE TO RELATED APPLICATION

The present application is a continuation-in-part of copending U.S. patent application Ser. No. 11/916,966, having a 371 (c)(1) date of Dec. 7, 2007, to Thomas G. Hill, et al., which is a 371 application of PCT International Application No. PCT/US2006/022264, filed Jun. 8, 2006, which claims benefit of U.S. Provisional Application No. 60/595,138, filed Jun. 8, 2005, the disclosures of each of which applications are hereby incorporated by reference in their entirety.

BACKGROUND

Subsurface valves are typically installed in strings of tubing deployed to subterranean wellbores to prevent the escape of fluid, from one production zone to another and/or to the surface. Possible applications of the embodiments of the present disclosure relate to all types of valves. For purposes of illustration this application discloses, as an example, safety valves used to shut in a well in the absence of continued hydraulic pressure from the surface. This example should not be used to limit the scope of the disclosure for non safety valve applications which may be readily apparent from the disclosure made herein to a person having ordinary skill in this art.

Without a safety valve, a sudden increase in downhole pressure can lead to catastrophic blowouts of production and other fluids into the atmosphere. For this reason, drilling and production regulations throughout the world require placement of safety valves within strings of production tubing before certain operations can be performed.

Various obstructions exist within strings of production tubing in subterranean wellbores. Valves, whipstocks, packers, plugs, sliding side doors, flow control devices, landing nipples, and dual completion components can obstruct the deployment of capillary tubing strings to subterranean production zones. Particularly, in circumstances where stimulation operations are to be performed on non-producing hydrocarbon wells, the obstructions stand in the way of operations that are capable of obtaining continued production out of a well long considered "depleted." Most depleted wells are not lacking in hydrocarbon reserves, rather the natural pressure of the hydrocarbon-producing zone is insufficient to overcome the hydrostatic pressure or head of the production column. Often, secondary recovery and artificial lift operations will be performed to retrieve the remaining resources, but such operations are often too complex and costly to be performed on a well. Fortunately, many new systems enable continued hydrocarbon production without costly secondary recovery and artificial lift mechanisms. Many of these systems utilize the periodic injection of various chemical substances into the wellbore to stimulate the production zone thereby increasing the production of marketable quantities of oil and gas. However, obstructions in a producing well often stand in the way to deploying an injection conduit to the production zone so that the stimulation chemicals can be injected. While many of these obstructions are removable, they are typically components required to maintain production of the well and permanent removal is not feasible. Therefore, a mechanism to work around them would be highly desirable.

One of the most common of these obstructions found in production tubing strings are subsurface safety valves. Subsurface safety valves are typically installed in strings of tubing deployed to subterranean wellbores to prevent the escape of fluids from one zone to another. Frequently, subsurface safety valves are installed to prevent production fluids from blowing out of a lower production zone either to an upper zone or to the surface. Absent safety valves, sudden increases in downhole pressure can lead to disastrous blowouts of fluids into the atmosphere or other wellbore zones. Therefore, numerous drilling and production regulations throughout the world require safety valves within strings of production tubing before many operations are allowed to proceed.

Safety valves allow communication between zones under regular conditions and are typically designed to close when undesirable downhole conditions exist. One popular type of safety valve is commonly referred to as a flapper valve. Flapper valves typically include a closure member generally in the form of a circular or curved disc that engages a corresponding valve seat to isolate zones located above and below the flapper in the subsurface well. A flapper disc is preferably constructed such that the flow through the flapper valve seat is as unrestricted as possible. Flapper-type safety valves are typically located within the production tubing and isolate production zones from upper portions of the production tubing. Optimally, flapper valves function as high-clearance check valves, in that they allow substantially unrestricted flow therethrough when opened and completely seal off flow in at least one direction when closed. Particularly, production tubing safety valves prevent fluids from production zones from flowing up the production tubing when closed but still allow for the flow of fluids (and movement of tools) into the production zone from above.

Flapper valve disks are often energized with a biasing member (spring, hydraulic cylinder, etc.) such that in a condition with zero flow and with no actuating force applied, the valve remains closed. In this closed position, any build-up of pressure from the production zone below will thrust the flapper disc against the valve seat and act to strengthen any seal therebetween. During use, flapper valves are opened by various methods to allow the free flow and travel of production fluids and tools therethrough. Flapper valves may be kept open through hydraulic, electrical, or mechanical energy during the production process.

Non-limiting examples of subsurface safety valves can be found in U.S. Provisional Patent Application Ser. No. 60/593,216 filed Dec. 22, 2004 by Tom Hill, Jeffrey Bolding, and David Smith entitled "Method and Apparatus of Fluid Bypass of a Well Tool"; U.S. Provisional Patent Application Ser. No. 60/593,217 filed Dec. 22, 2004 by Tom Hill, Jeffrey Bolding, and David Smith entitled "Method and Apparatus to Hydraulically Bypass a Well Tool"; U.S. Provisional Patent Application Ser. No. 60/522,360 filed Sep. 20, 2004 by Jeffrey Bolding entitled "Downhole Safety Apparatus and Method"; U.S. Provisional Patent Application Ser. No. 60/522,500 filed Oct. 6, 2004 by David R. Smith and Jeffrey Bolding entitled "Downhole Safety Valve Apparatus and Method"; and U.S. Provisional Patent Application Ser. No. 60/522,499 filed Oct. 7, 2004 by David R. Smith and Jeffrey Bolding entitled "Downhole Safety Valve Interface Apparatus and Method". Each of the above references is hereby incorporated by reference in its entirety.

One popular means to counteract the closing force of the biasing member and any production flow therethrough involves the use of capillary tubing to operate the safety valve flapper through hydraulic pressure. Traditionally, production tubing having a subsurface safety valve mounted thereto is disposed in a wellbore to a depth of investigation. In this circumstance, the capillary tubing used to open and shut the subsurface safety valve is deployed in the annulus formed between the outer surface of the production tubing and the inner wall of the borehole or casing. A fitting outside of the subsurface safety valve connects to the capillary tubing and allows pressure in the capillary to operate the flapper of the safety valve. Furthermore, because former systems were run with the production tubing, installations after the installation of production tubing in the wellbore are evasive. To accomplish this, the production tubing must be retrieved, the safety valve installed, the capillary tubing attached, and the production tubing, safety valve, and capillary tubing assembly run back into the hole. This expense and time consumed are such that it can only be performed on wells having a long-term production capability to justify the expense.

The present disclosure generally relates to hydrocarbon producing wells where production of the well can benefit from continuous injection of a fluid. More specifically, injection of a fluid from the surface through a small diameter, or capillary, tubing. Exemplary, non-limiting applications of fluid injection are: injection of surfactants and/or foaming agents to aid in water removal from a gas well; injection of de-emulsifiers for production viscosity control; injection of scale inhibitors; injection of inhibitors for asphaltine and/or diamondoid precipitates; injection of inhibitors for paraffin deposition; injection of salt precipitation inhibitors; injection of chemicals for corrosion control; injection of lift gas; injection of water; injection of hydraulic oil, such as through a stinger, to operate a wireline valve (as will be described in greater detail with respect to FIGS. 9A and 9B below) and injection of any production-enhancing fluid. Further production applications include the insertion of a tubing string hanging from a wireline retrievable surface controlled subsurface safety valve for velocity control.

Many wells throughout the world have surface controlled subsurface safety valves ("SCSSV") installed in the production tubing, and such valves are well known by those of ordinary skill in the art of completion engineering and operation of oil and gas wells. SCSSVs fall into two generic types: tubing retrievable ("TR") valves and wireline retrievable ("WR") valves.

TR valves are attached to the production tubing and are deployed and removed from the well by deploying or removing the production tubing from the well. Removing the production tubing is typically cost prohibitive because a drilling rig must be mobilized, which can cost the operator of the well millions of dollars.

In sharp contrast, WR valves are deployed by wireline or slickline. Deploying WR valves via wireline or slickline is typically significantly less expensive to deploy and retrieve than TR valves. WR valves can also be referred to as "insert valves" because they can be adapted to be inserted inside either a TR valve or a hydraulic nipple in situ. Additionally, WR valves can be removed without removal of the production tubing. The actual method of deployment for WR valves is not critical to the claimed invention. Deployment methods utilizing slickline, wireline, coiled tubing, capillary tubing, or work string can be used in conjunction with the claimed invention. For the purposes of this patent, WR shall be used to describe any valve that is not a TR valve.

Because SCSSVs are a critical safety device used in virtually all modern wells, the manufacture and design of SCSSVs is controlled by the American Petroleum Institute ("API"). The current controlling specification published by API for SCSSVs is API-14a. While API-14a provides design and manufacture guidance for current SCSSVs, embodiments of the present disclosure can be adapted to incorporate new features or specifications required by future specifications that control the design and manufacture of SCSSVs.

API-14a currently requires certification testing, typically performed by a third party. In addition to the testing required by API-14a, valve manufacturers generally require a rigorous series of testing of new valve designs which can entail weeks or even months of in-house testing. The significant testing requirements imposed by API-14a and by manufacturers can result in newly designed SCSSVs taking months or even years to develop and perfect and can often cost manufacturers hundreds of thousands of dollars.

A new apparatus and method of use has been developed that solves the problems inherent with the prior art. The bypass passageway apparatus described herein has been adapted to work in concert with the invention described in U.S. Provisional Application Ser. No. 60/595,137, filed Jun. 8, 2005 by Jeffrey Bolding and Thomas Hill entitled "Wellhead Bypass Method and Apparatus", a copy of which is hereby incorporated by reference as if set out fully herein. Although the bypass passageway apparatus described herein is compatible with the above invention, the bypass passageway apparatus of the present application can be used without the benefit of the Wellhead Bypass Method and Apparatus.

The bypass passageway apparatus enables a production-stimulating fluid to be injected into a wellbore using capillary tubing while maintaining the operation of a safety valve. As the demand for the bypass passageway apparatus is expected to be extremely high, there is a need for a means to convert existing certified designs to the bypass passageway apparatuses of the present application. For simplification, a WRSCSSV that has been converted to a bypass passageway apparatus shall be referred to as an "enhanced WRSCSSV".

The present application discloses a conversion kit that enables a WRSCSSV to be converted to a bypass passageway apparatus. In addition, the present application discloses an enhanced WRSCSSV adapted to hang tubing. The present application also discloses a method for performing artificial lift using a bypass passageway apparatus. Finally, the present application discloses a method of injecting a production-enhancing fluid into a well while maintaining safety valve operation using a bypass passageway apparatus.

SUMMARY

An embodiment of the present disclosure is directed to a wellbore injection system. The wellbore injection system comprises a capillary fluid flow path positioned in a subsurface wellbore so as to allow fluid communication through the wellbore, the wellbore having a wellbore pressure. A receptacle is in fluid communication with a second fluid flow path that is positioned below the capillary fluid flow path in the wellbore. An injector is attached to a distal end of the capillary fluid flow path, the injector comprising an injector flow path. The injector is capable of being removably attached to the receptacle to provide fluid communication between the capillary fluid flow path and the second fluid flow path through the injector flow path. An isolation mechanism is capable of isolating the capillary fluid flow path from the wellbore pressure when the injector is not attached to the receptacle.

Another embodiment of the present disclosure is directed to an injector isolation system for use in a wellbore. The wellbore comprises a capillary fluid flow path providing fluid communication through the wellbore. A receptacle is in fluid communication with a second fluid flow path that is positioned below the capillary fluid flow path in the wellbore. The injector isolation system comprises an injector capable of being attached to a distal end of the capillary fluid flow path. The injector comprises an injector flow path through which fluid can pass into and out of the injector. The injector is capable of being removably attached to the receptacle to provide fluid communication between the capillary fluid flow path and the second fluid flow path through the injector flow path. An isolation mechanism is capable of isolating the capillary fluid flow path from the wellbore pressure when the injector is not attached to the receptacle.

Another embodiment of the present disclosure is directed to a kit for enhancing a wireline retrievable surface controlled subsurface safety valve ("enhanced WRSCSSV") to inject a fluid while maintaining safety valve operation. The components can include a locking mandrel, an upper adapter, a lower adapter, and/or an injection bypass passageway. The kit can further include a WRSCSSV, a spacer tube, a tubing string hanger attached to the lower adapter for hanging a tubing string, and/or one or more packings to seal the enhanced WRSCSSV to the side of the wellbore. The spacer tube, locking mandrel, and/or the upper adapter can include a receptacle removably receiving an injector for injecting fluid into the bypass passageway. In any embodiment, the kit can include the necessary upper and/or lower capillary tube(s) depending on customer requirements.

A kit for enhancing a wireline retrievable surface controlled subsurface safety valve to inject a production-enhancing fluid while maintaining operability of the wireline retrievable surface controlled subsurface safety valve can include an upper adapter connected to a locking mandrel and adapted to connect to a proximal end of the wireline retrievable surface controlled subsurface safety valve, a lower adapter adapted to connect to a distal end of the wireline retrievable surface controlled subsurface safety valve, and a bypass passageway extending between the upper and the lower adapters allowing fluid communication around the wireline retrievable surface controlled subsurface safety valve. The kit can include a tubing string hanger. Bypass passageway can be external the wireline retrievable surface controlled subsurface safety valve. The kit can include a spacer tube, which can be disposed between the upper adapter and the locking mandrel. At least one of the upper adapter, locking mandrel, and lower adapter can include a packing to seal said at least one of the upper adapter, locking mandrel, and lower adapter to a wellbore. A bypass passageway can include a check valve.

An upper capillary tube can be connected to the upper adapter, the upper capillary tube in communication with the bypass passageway. A receptacle of the upper adapter can removably receive an injector disposed on a distal end of an upper capillary tube, the receptacle in communication with the bypass passageway. A lower capillary tube can be connected to the lower adapter, the lower capillary tube in communication with the bypass passageway. The lower capillary tube can include or be connected to a gas lift valve. A bypass passageway can include a capillary tube. The kit can include the wireline retrievable surface controlled subsurface safety valve.

In another embodiment, a method of enhancing a wireline retrievable surface controlled subsurface safety valve includes connecting an upper adapter to a proximal end of the wireline retrievable surface controlled subsurface safety valve, connecting a lower adapter to a distal end of the wireline retrievable surface controlled subsurface safety valve, and providing a bypass passageway extending between the upper and lower adapters. The bypass passageway can be external the wireline retrievable surface controlled subsurface safety valve. The method can include connecting a locking mandrel to the upper adapter and/or disposing a spacer tube between the locking mandrel and the upper adapter. The spacer tube can include a receptacle removably receiving an injector disposed on a distal end of an upper capillary tube, the receptacle in communication with the bypass passageway. Bypass passageway can be a capillary tube. Bypass passageway can include a check valve.

A method of enhancing a wireline retrievable surface controlled subsurface safety valve can include connecting an upper capillary tube to the upper adapter, the upper capillary tube in communication with the bypass passageway. A method of enhancing a wireline retrievable surface controlled subsurface safety valve can include connecting a lower capillary tube to the lower adapter, the lower capillary tube in communication with the bypass passageway. A method can include connecting a tubing hanger to the lower adapter.

In yet another embodiment, a method of injecting a production-enhancing fluid into a well while maintaining operation of an enhanced wireline retrievable surface controlled subsurface safety valve includes connecting an upper adapter to a proximal end of a wireline retrievable surface controlled subsurface safety valve, connecting a lower adapter to a distal end of the wireline retrievable surface controlled subsurface safety valve, providing a bypass passageway extending between the lower and upper adapters and external to the wireline retrievable surface controlled subsurface safety valve to form the enhanced wireline retrievable surface controlled subsurface safety valve, connecting an upper capillary tube to the upper adapter, the upper capillary tube in communication with the bypass passageway, inserting the enhanced wireline retrievable surface controlled subsurface safety valve into a wellbore, sealing the enhanced wireline retrievable surface controlled subsurface to the wellbore with a packing, and injecting the production-enhancing fluid into the wellbore below the safety valve through the upper capillary tube and the bypass passageway. The production-enhancing fluid can be a surfactant, a foaming agent, a de-emulsifier, a diamondoid precipitate inhibitor, an asphaltine inhibitor, a paraffin deposition inhibitor, a salt precipitation inhibitor, a corrosion control chemical, and/or an artificial lift gas.

A method of injecting a production-enhancing fluid into a well while maintaining operation of an enhanced wireline retrievable surface controlled subsurface safety valve can include connecting a lower capillary tube to the lower adapter, the lower capillary tube in communication with the bypass passageway, and injecting the production-enhancing fluid into the wellbore below the enhanced wireline retrievable surface controlled subsurface safety valve through the upper capillary tube, the bypass passageway, and the lower capillary tube. The method can further include connecting a gas lift valve to the lower capillary tube, suspending a tubing string from a tubing hanger connected to the lower adapter, and/or disposing a locking mandrel connected to the upper adapter into a nipple profile of the wellbore. The tubing string can be a velocity tubing string.

A method of injecting a production-enhancing fluid into a well while maintaining operation of an enhanced wireline retrievable surface controlled subsurface safety valve can include flowing a produced fluid through an annulus formed between the velocity tubing string and the wellbore. A method can include flowing a produced fluid through the velocity tubing string. A method can include connecting a lower capillary tube to the lower adapter, the lower capillary tube extending within the velocity tubing string and in communication with the bypass passageway, and injecting the production-enhancing fluid into the wellbore below a distal end of the velocity tubing string through the upper capillary tube, the bypass passageway, and the lower capillary tube. A method can include connecting a gas lift valve to a distal end of the lower capillary tube, and injecting the production-enhancing fluid into the wellbore below the enhanced wireline retrievable surface controlled subsurface safety valve through the upper capillary tube, the bypass passageway, the lower capillary tube, and the gas lift valve.

The present application further discloses a method of enhancing a certified WRSCSSV by connecting an upper capillary tube to a locking mandrel, connecting the locking mandrel to an upper adapter, connecting the upper adapter to a WRSCSSV and a bypass passageway, connecting the WRSCSSV to a lower adapter, and connecting the bypass passageway or pathway to the lower adapter. In addition, a spacer tube containing an injector and receptacle can be inserted between the locking mandrel and upper adapter. The spacer tube can also include a bypass passageway, which can simply be a capillary tube. A check valve can be installed on the lower adapter to prevent flow from the wellbore into the injection tubing. A capillary tube can also be installed on the check valve to provide deeper injections.

In another embodiment, a method for injecting production-enhancing fluids into a well while maintaining safety valve operation is disclosed. The method includes inserting an enhanced WRSCSSV into a wellbore with an upper capillary tube, forming a seal between the safety valve and the wellbore, and injecting production-enhancing fluid into the wellbore below the safety valve using the upper capillary tube and a bypass passageway. Production-enhancing fluids can include surfactants, foaming agents, de-emulsifiers, diamondoid precipitate inhibitors, asphaltine precipitate inhibitors, paraffin deposition inhibitors, salt precipitation inhibitors, corrosion control chemicals, artificial lift gas, water, and the like. The method enables inserting a single fluid or combinations of fluid that can provide production enhancement.

In another embodiment, a kit for converting a certified WRSCSSV into an enhanced WRSCSSV to act as a hanger while maintaining well safety is disclosed. This embodiment can include a locking mandrel, an upper adapter, and a lower adapter including a hanger. In addition, the kit may include a pre-certified WRSCSSV. The kit may also include a spacer tube and packing to seal the enhanced WRSCSSV to the side of the wellbore. The kit can also be provided with a lower capillary tube which may act as a velocity tube string.

Another embodiment discloses a method for enhancing a standard WRSCSSV to incorporate bypass passageway to hang tubing while maintaining well safety valve operation. This method includes connecting a locking mandrel to an upper adapter, connecting the upper adapter to a WRSCSSV and a bypass passageway, connecting the WRSCSSV to a lower adapter, connecting the bypass passageway to the lower adapter, and connecting a tubing string to the lower adapter. The tubing string can be any type of tubing string commonly used in the oilfield industry including a velocity string, for example. The velocity string can be used such that produced fluid flows up the well within the velocity string or in the external annulus created between the velocity string and the production tubing.

Another embodiment of the present application includes a method of hanging a tubing string in a well while maintaining safety valve operation comprising: affixing a tubing string to the lower adapter of an enhanced WRSCSSV, inserting the tubing string and enhanced WRSCSSV into a wellbore, and sealing the WRSCSSV to the wellbore. The tubing string can be any type of tubing string known to one of ordinary skill in the art such as, for example, a velocity string.

An additional embodiment describes a kit for enhancing a WRSCSSV to use bypass passageway to perform artificial lift while maintaining well safety. This kit comprises a locking mandrel, an upper adapter, a bypass passageway, a lower adapter, a tubing string, a lower capillary tube, and a gas lift valve. The gas lift valve can be any standard valve used in the oilfield industry to control the rate of flow of artificial lift gases into a well. The kit can optionally include a WRSCSSV, a spacer tube, a hanger, a packing seal, and/or a check valve on the lower adapter. In addition, the upper adapter can include an injector and receptacle. In some cases the upper capillary tube can be included. Optionally, the bypass passageway can be a capillary tube.

Another embodiment describes a method of enhancing a WRSCSSV to utilize bypass passageway to perform artificial lift operations while maintaining safety valve operation. This method can include connecting an upper capillary tube to a locking mandrel, connecting the locking mandrel to an upper adapter, connecting the upper adapter to a WRSCSSV and a bypass passageway, connecting the WRSCSSV to a lower adapter, connecting the bypass passageway to the lower adapter, connecting a tubing string to the lower adapter, connecting a gas lift valve to a lower capillary tube, and connecting the lower capillary tube to the lower adapter.

An additional embodiment describes a method for performing artificial lift operations on a well while maintaining safety valve operation. This method includes connecting an upper capillary tube to the locking mandrel of an enhanced WRSCSSV, connecting a tubing string to the lower adapter of an enhanced wireline retrievable surface controlled subsurface safety valve, connecting a gas lift valve to a lower capillary tube, connecting the lower capillary tube to the lower adapter of the enhanced wireline retrievable surface controlled subsurface safety valve, inserting the tubing string, capillary tubes, and enhanced wireline retrievable surface controlled subsurface safety valve into a wellbore, sealing the safety valve to the wellbore, and injecting artificial lift gas into the wellbore below the safety valve via the enhanced wireline retrievable surface controlled subsurface safety valve and a bypass passageway.

Still another embodiment of the present disclosure is directed to a kit for enhancing a wireline retrievable surface controlled subsurface safety valve to inject a production-enhancing fluid while maintaining operability of the wireline retrievable surface controlled subsurface safety valve. The kit comprises an upper adapter connected to a locking mandrel and adapted to connect to a proximal end of the wireline retrievable surface controlled subsurface safety valve. A lower adapter is adapted to connect to a distal end of the wireline retrievable surface controlled subsurface safety valve. A bypass passageway extending between the upper and the lower adapters allowing fluid communication around the wireline retrievable surface controlled subsurface safety valve. A receptacle of the upper adapter is capable of removably receiving an injector disposed on a distal end of an upper capillary tube, the receptacle being in communication with the bypass passageway. An isolation mechanism is capable of isolating the capillary tube from a wellbore pressure when the injector is not received by the receptacle.

BRIEF DESCRIPTION OF THE DRAWINGS

FIGS. 3-1 through 3-9 show a cross-sectional view of another embodiment of the present application, wherein the bypass passageway kit is attached to a WRSCSSV which is further inserted inside a TRSCSSV.

FIG. 4B is a schematic view depicting an alternative configuration of the embodiment of FIG. 4A wherein the bypass passageway extends within the velocity tubing string.

FIG. 5 is a schematic view of an additional embodiment of the present application depicted with the enhanced WRSCSSV preserving well safety and including a tubing hanger suspending a velocity tubing string.

FIG. 6 is a schematic view of a wellbore injection system, according to an embodiment of the present disclosure.

10A and 10B illustrate a male receptacle and female injector arrangement, according to an embodiment of the present disclosure.

FIGS. 11 to 14 illustrate an injection system having an added isolation mechanism, according to an embodiment of the present disclosure.

Figure 16:
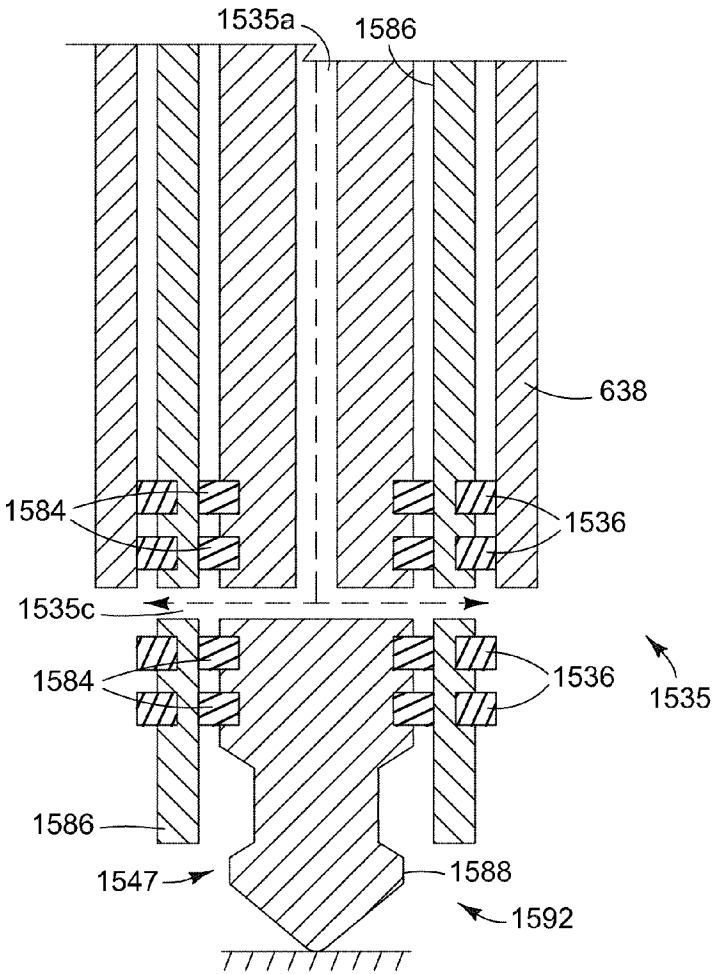
Figure 15:
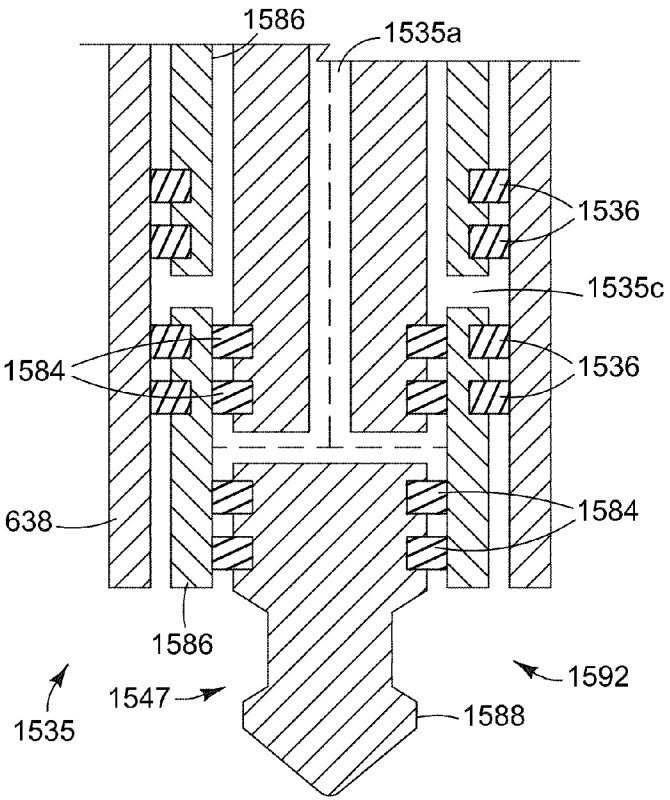

FIGS. 15 and 16 illustrate an embodiment of another isolation mechanism, according to an embodiment of the present disclosure.

DETAILED DESCRIPTION

Figure 1:
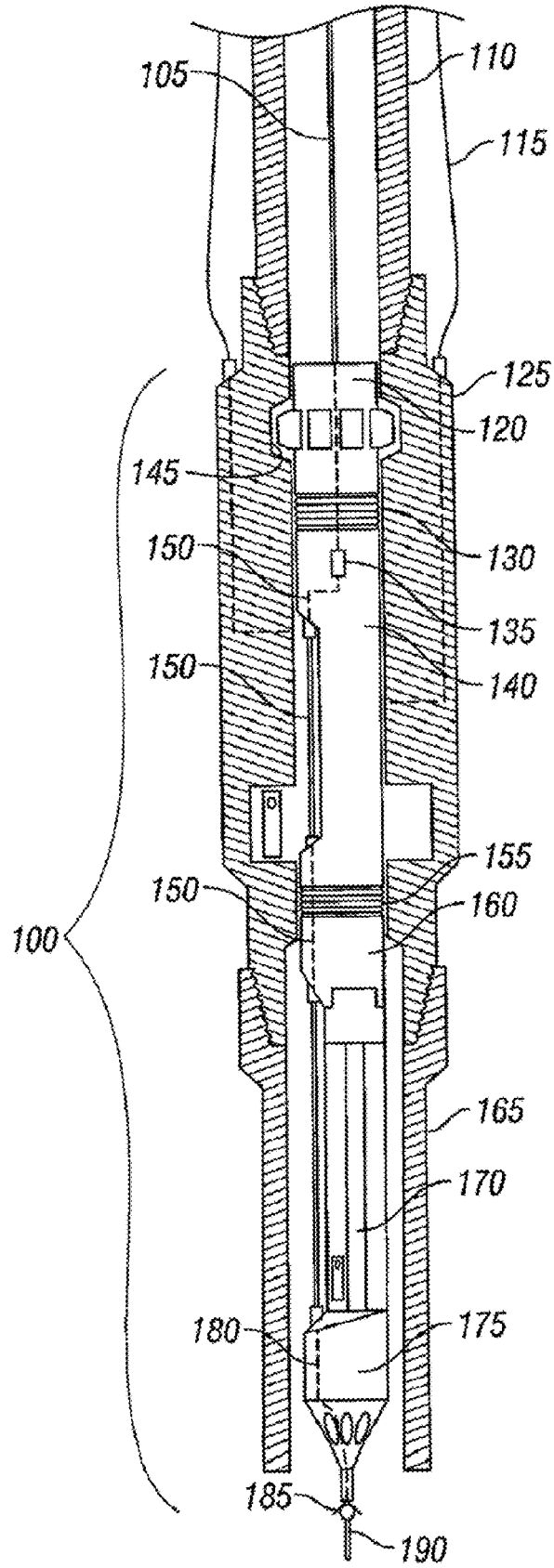
FIG. 1 is a schematic view of one embodiment of a kit enhanced wireline retrievable surface controlled subsurface safety valve ("enhanced WRSCSSV") shown inserted in a tubing retrievable surface controlled subsurface safety valve ("TRSCSSV").

Referring initially to FIG. 1, one embodiment of a kit for enhancing a wireline retrievable surface controlled subsurface safety valve ("WRSCSSV") 170 is shown installed. An enhanced wireline retrievable surface controlled subsurface safety valve ("enhanced WRSCSSV") 100 kit can include an upper adapter 160, a lower adapter 175, and a bypass passageway 150 extending between the upper 160 and lower 175 adapters to maintain operability of the WRSCSSV 170. Although not shown, a seal, for example packing, can be included on either or both of upper 160 and lower 175 adapters to seal the enhanced WRSCSSV 100 to the bore of a tubular housing said valve. A packing can seal the enhanced WRSCSSV 100 to the bore of the tubular, for example, production tubing, so that fluid flow is routed through the bore of the WRSCSSV 170 while the bypass passageway 150 allows fluidic communication independent of the position of a closure member of the WRSCSSV 170.

An upper capillary tube 105 can be connected to any portion of the enhanced WRSCSSV assembly 100. Upper capillary tube 105 can connect directly to the upper adapter 160 and be in communication with bypass passageway 150 if desired. A connection can be of any type known in the art including flange, quick-connect, threaded, or the like. In addition, a hydraulic control line 115 can be connected to a tubing retrievable surface controlled subsurface safety valve ("TRSCSSV") 125 separately from the upper production tubing 110. Enhanced WRSCSSV assembly 100 is not limited to installation within a TRSCSSV 125 as shown and can be mounted in any wellbore and/or production tubing if desired. The enhanced WRSCSSV assembly 100 can further include a locking mandrel 120 for engagement within a nipple profile 145 for securing to the TRSCSSV 125, or any type of anchor for securing a downhole component within a tubing string. Locking mandrel 120 can be disposed at any portion of enhanced WRSCSSV assembly 100 and is not limited to connection to the proximal end of spacer tube 140 as shown. Enhanced WRSCSSV assembly 100 can be sealed within the wellbore, here the bore of TRSCSSV 125, by a packing (130, 155). Upper packing 130 is shown disposed between optional locking mandrel 120 and optional spacer tube 140. Spacer tube 140 connects the upstream end of the locking mandrel 120 to the downstream end of upper adapter 160. Spacer tube 140 can ensure the WRSCSSV is installed in the lower production tubing 165, preferably below the closure member of TRSCSSV 125 so said closure member does not interfere with the injection of production-enhancing fluids. For example, if distal end of lower adapter 175 of enhanced WRSCSSV assembly 100 is downstream of closure member of TRSCSSV 125, lower capillary tube 190 would extend through the bore of the TRSCSSV 125 and activation of the closure member of TRSCSSV 125 could sever lower capillary tube 190. As a closure member of a TRSCSSV 125 is typically biased to a closed position and nipple profile 145 is typically a fixed distance from the closure member, utilizing a spacer tube 140 of a desired length allows an enhanced WRSCSSV assembly 100 to extend through the bore of the TRSCSSV 125 adjacent the closure member to prevent the severing of lower capillary tube 190 and can further serve to retain the closure member of TRSCSSV 125 in an open position.

Lower packing 155 is shown disposed between upper adapter 160 and spacer tube 140 to provide a seal within the TRSCSSV 125. Upper adapter 160 can connect spacer tube 140 to a WRSCSSV 170, although the use of a spacer tube 140 is optional. The WRSCSSV 170 can be disposed within the lower production tubing 165 and attached to the lower adapter 175. Lower adapter 175 connects the WRSCSSV 170 and connects to the optional check valve 185 and lower capillary tubing 190.

An injected fluid can pass from upper capillary tube 105, for example, from a surface location, through an upper portion of bypass passageway 150 contained in locking mandrel 120. Optionally, an injector and injector receptacle 135 can be utilized if desired. As the receptacle is in communication with upper portion of bypass passageway 150, an injector disposed on the distal end of upper capillary tube 105 can be removably received within the receptacle to facilitate communication between the upper capillary tube 105 and the bypass passageway 150. Fluid can further travel through optional spacer tube 140 via an intermediate portion of bypass passageway 150. A lower portion of bypass passageway 150 extends through the upper adapter 160 and connects to portion 180 of bypass passageway 150. Portion 180 of bypass passageway 150 extends from upper adapter 160 and through the lower adapter 175 to allow bypass passageway 150 to connect to lower capillary tube 190. Lower adapter 175 can serve as a tubing string hanger to support the lower capillary tubing 190 and/or any tubing string.

In the embodiment shown, the portion of bypass passageway 150 that is coterminous with WRSCSSV 170 is routed external to the bore of WRSCSSV 170 so as not to impede the actuation of any closure member of WRSCSSV 170. A further benefit of such a configuration is that a standard WRSCSSV 170 can be used as no modification to the WRSCSSV 170 itself is required. A control line (not shown) to actuate WRSCSSV 170 can be any type or configuration known in the art.

Bypass passageway (150, 180) can be any conduit suitable for the flow of fluids including passageways or pathways machined into the tools, capillary tubing, piping, metallic tubing, non-metallic tubing, or the like. Upper capillary tubing 105, lower capillary tubing 190, and bypass passageway (150, 180) can be a single conduit if so desired.

The embodiment of FIG. 1 is one example of an installation of an existing WRSCSSV 170 retrofitted (e.g., enhanced) with a bypass passageway kit to maintain operation of the WRSCSSV 170 while allowing fluid injection independent of the position of any closure member of the WRSCSSV 170. Bypass passageways 150 and 180 allow continuous injection of a fluid into the wellbore below the safety valve without compromising the WRSCSSV 170 operation and without necessitating removal of the production tubing and/or TRSCSSV 125 to install a bypass.

Figure 2A:
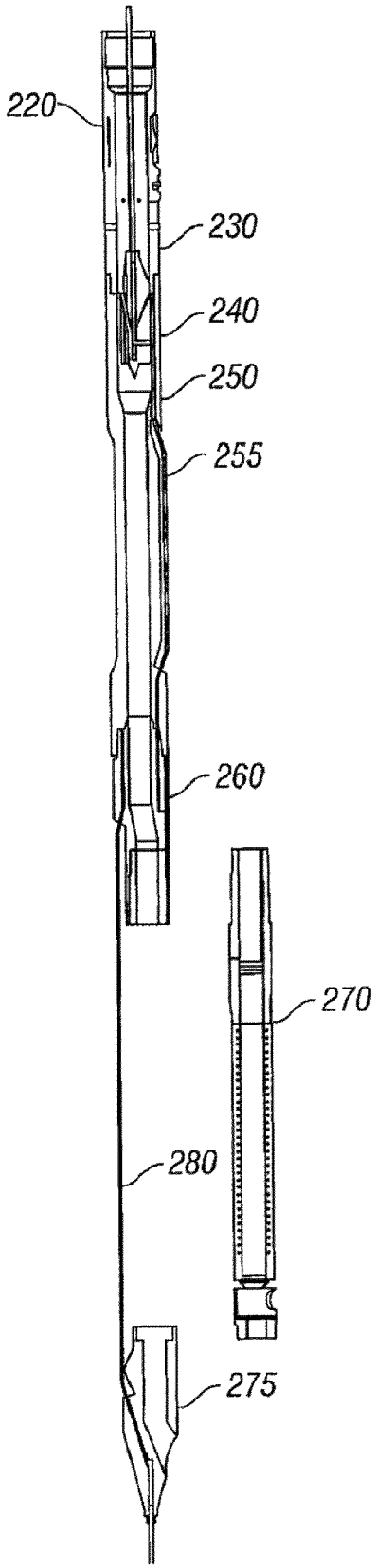
FIG. 2A is a cross-sectional view of another embodiment of the present application, wherein a standard certified wireline retrievable surface controlled subsurface safety valve ("WRSCSSV") is shown before enhancement with the bypass passageway conversion kit.

FIG. 2A depicts another embodiment of a bypass passageway kit to enhance a WRSCSSV 270 before assembly with the WRSCSSV 270. Any portion of enhanced WRSCSSV assembly, including WRSCSSV 270 itself, can include a packing to seal the enhanced WRSCSSV to an adjacent surface. As shown, upper packing 230 can be disposed circumferential the exterior of locking mandrel 220 to seal against the side of the wellbore tubing or existing TRSCSSV when installed. Locking mandrel 220 include a bypass passageway 250 to connect to the bypass passageway 255 contained in and/or extending adjacent to spacer tube 240. Spacer tube 240 can be of any appropriate size for a given well configuration to ensure the WRSCSSV 270 is installed in a desired location. Spacer tube 240 is connected between locking mandrel 220 and upper adapter 260. Upper adapter 260 can connects spacer tube bypass passageway 255 in spacer tube 240 to bypass passageway 280. Bypass passageway is preferably external to the WRSCSSV 270, allowing the use of any standard WRSCSSV without modifying the body of the WRSCSSV, which may allow the avoidance of redesigning and certifying a new WRSCSSV that contains an integral bypass passageway.

While the present application is especially suited for a bypass passageway 280 external to the WRSCSSV, one of ordinary skill in the art would recognize that a WRSCSSV containing an integral bypass passageway can be used. External bypass passageway 280 extends between upper adapter 260 to lower adapter 275 to allow fluid communication therebetween in at least one direction.

Figure 2B:
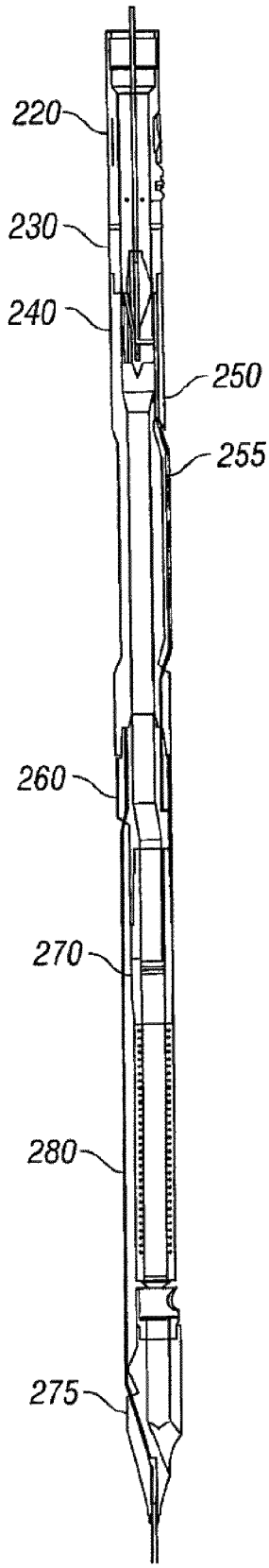
FIG. 2B is a cross-sectional view of the embodiment of FIG. 2A wherein a standard certified wireline retrievable surface controlled subsurface safety valve ("WRSCSSV") is shown modified by the bypass passageway conversion kit to form the enhanced WRSCSSV.

FIG. 2B is the WRSCSSV 270 after enhancement with the kit components of FIG. 2A. Preferably, the longitudinal bores of the locking mandrel 220, spacer tube 240, upper adapter 260, and lower adapter 275 are sized similar to the longitudinal bore of the WRSCSSV 270 so as not to impede the flow of any produced fluid therethrough. Although an injector and receptacle are illustrated in the proximal end of the embodiment of FIGS. 2A-2B, an upper capillary tube can connect directly to any portion of the bypass passageway (280, 255) without the use of an injector and receptacle. The enhanced WRSCSSV assembly of FIG. 2B can be installed within a string of production tubing by any means know to one of ordinary skill in the art and as the bypass passageway (280, 255) is disposed therewith, the string of production tubing does not require modification and/or removal and reinsertion. For example, a leak in a bypass which extends through the wall of the production tubing (not shown) can lead to leakage in the wellbore (e.g., external to the production tubing) itself, whereas any leak of the bypass passageway (280, 255) encountered with embodiments of the present disclosure will be contained within the production tubing.

Referring now to FIGS. 3-1 through 3-9, another embodiment of the present application is shown. Bypass passageway (350, 380) allows injection of a fluid (348, 382) around a WRSCSSV 370. Locking mandrel 320 can be positioned within a TRSCSSV 325 as shown, but is not so limited. Locking mandrel 320 locks the enhanced WRSCSSV (e.g., bypass passageway assembly) to the locking profile 321 of TRSCSSV 325 via locking dogs 323. During normal operation, injection fluid 348 can flow through bypass passageway (350, 380) into the well. Production flow 352 can rise through the outer annulus formed between the capillary tube 305 and the bore of the WRSCSSV 370. Locking mandrel 320 can be sealed within the bore of TRSCSSV 325 via upper packing 330 and connect to spacer tube 340. A packing (330, 355) can be engaged by any means known in the art. Upper capillary tube 305 passes through bore of locking mandrel 320 and spacer tube 340 to maintain injection through the bypass passageway (350, 380).

Distal end of upper capillary tube 305 is attached to an injector 335, which can be a stinger. Injector 335 is removably received by a receptacle 337 located within a proximal end of the upper adapter 360. Receptacle portion of upper adapter 360 is shown as a separate piece in FIG. 3-5, however it can be a single piece if desired. The location of the receptacle 337 in the enhanced WRSCSSV is not critical, but preferably is mounted downstream the closure member 374 of the WRSCSSV 370. Injector receptacle 337 contains at least one port in communication with bypass passageway 350 to allow the passage of fluid from the injector 335 into the bypass passageway 350, as shown more readily in FIG. 3-5. Bypass passageway 350 extends through the upper adapter 360. Bypass passageway 350 then connects to the lower portion of bypass passageway 380. As seen in FIGS. 3-6 to 3-9, bypass passageway 380 extends external to the WRSCSSV 370 to lower adapter 375.

Upper adapter 360 can further be sealed to the walls of the polished bore of the TRSCSSV 325 with lower packing 355. Upper 330 and lower 355 packing can be positioned between the bore of the TRSCSSV 325 and the exterior of the enhanced WRSCSSV as shown to fluidicly isolate a zone including closure member 327 of the TRSCSSV 325, for example, if control mechanism of TRSCSSV 325 has failed so as to create a leak of production fluid external the TRSCSSV 325.

Upper adapter 360 connects to a WRSCSSV 370. The portion of bypass passageway 350 within upper adapter 360 connects to an external portion 380 of bypass passageway, shown as a capillary tube with a ferrule fitting 373 on a proximal end thereof. Fluid 348 flows through bypass passageway 350 to bypass passageway 380. Fluid 348 in bypass passageway 380 shall be referred to as fluid 382 (see FIG. 3-7) and can be injected into the wellbore while maintaining the safety of the wellbore with closure member 374 of WRSCSSV 370 and its power spring 372. While a capillary tube and ferrule fitting are disclosed, one of ordinary skill in the art would readily recognize that any suitable fluid flow passageway or pathway and appropriate fitting can be used with embodiments of the present application. In the illustrated embodiment, fluid 382 can be injected into the wellbore in the zone sealed from the downstream portion of the closure member 374 of WRSCSSV 370 (i.e., typically the production zone) through the end of bypass passageway 350 such that a bypass passageway 380 and/or lower adapter 375 are not required.

Closure mechanism or flapper 374 of WRSCSSV 370 can be actuated by any means to impede or stop production flow 352 if desired, for example, if the well becomes over pressurized or otherwise unsafe. In the illustrated embodiment, WRSCSSV 370 and bypass passageway tubing 380 are connected to lower adapter 375. Lower adapter 375 can provide protection, for example, protection from crushing contact with the bore of the TRSCSSV 325, and/or provide support to lower capillary tube 386. Lower adapter 375 further includes a tubing retainer or hanger 384 and a flow nozzle 395. Tubing retainer 384 can function to hang a lower capillary tube 386 below the flow nozzle 395. Distal end of lower capillary tube 386 can extend to any desired depth to allow dispersal of the injected fluid 382 below the WRSCSSV 370, or more specifically, the zone upstream of the closure member 374 of the WRSCSSV 370. Optional flow nozzle 395 can aid the flow of production flow 352 into the bore extending through the enhanced WRSCSSV of FIGS. 3-1 to 3-9.

Figures 1, 3:
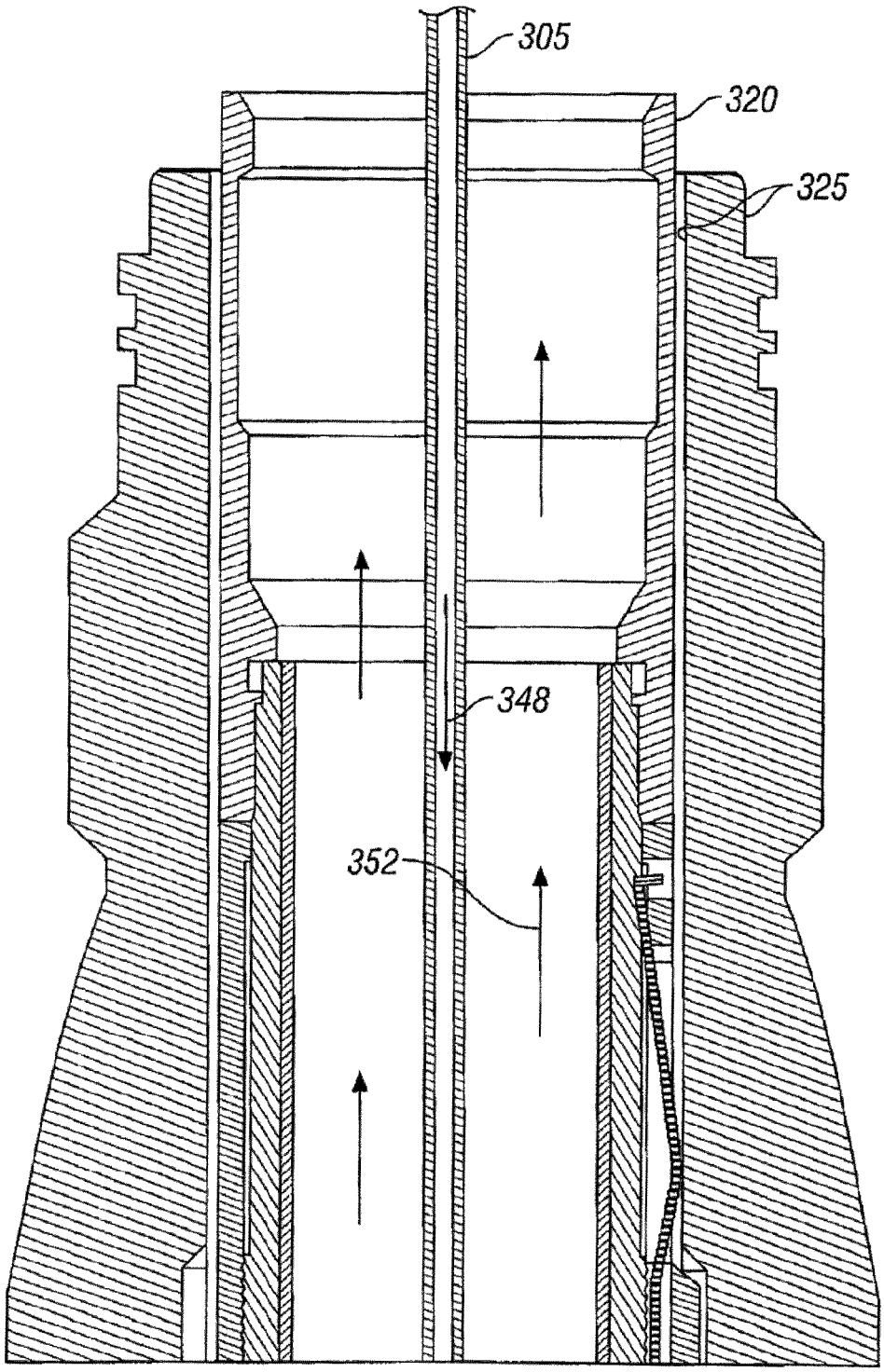
Figures 2, 3:
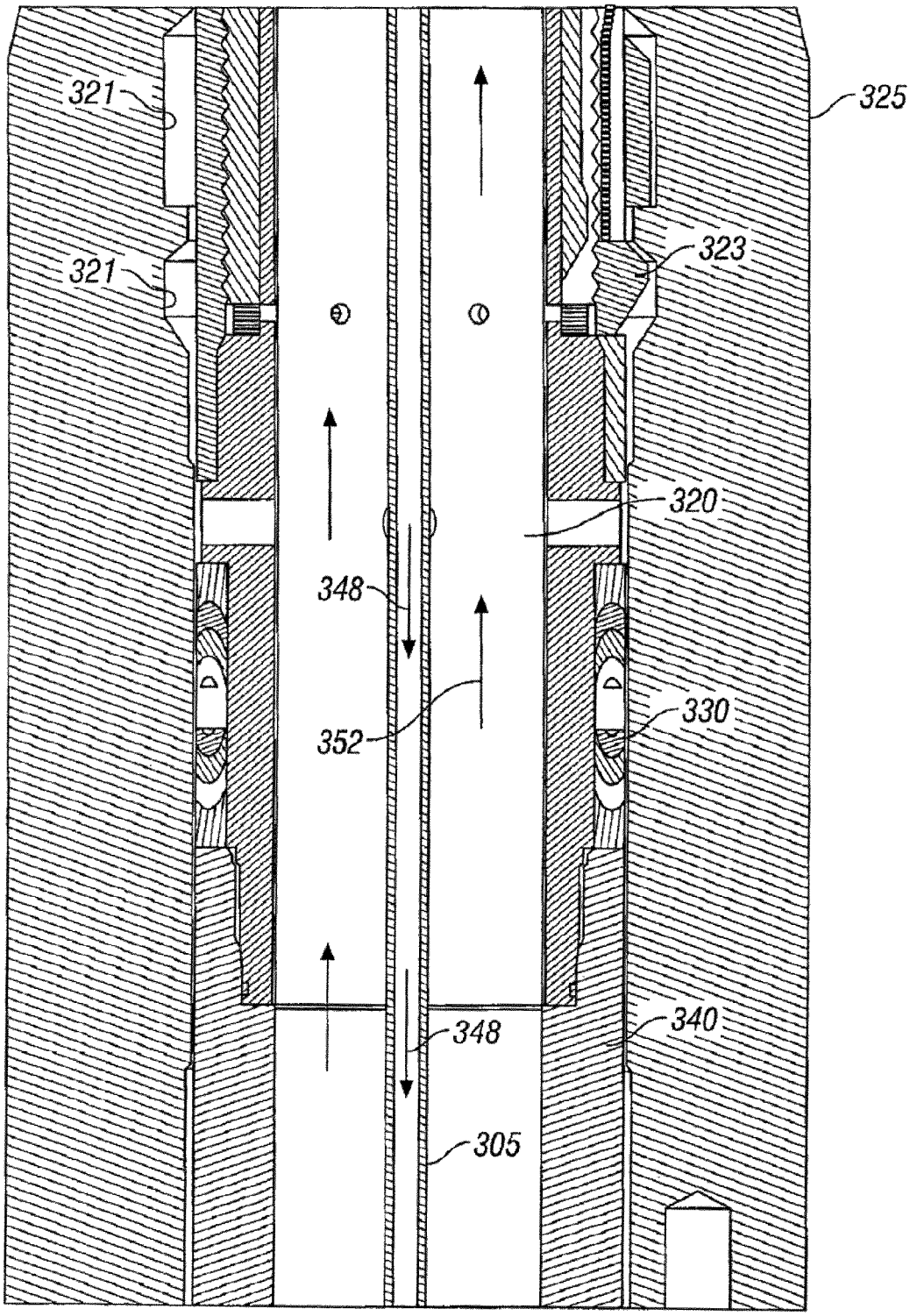
Figure 3:
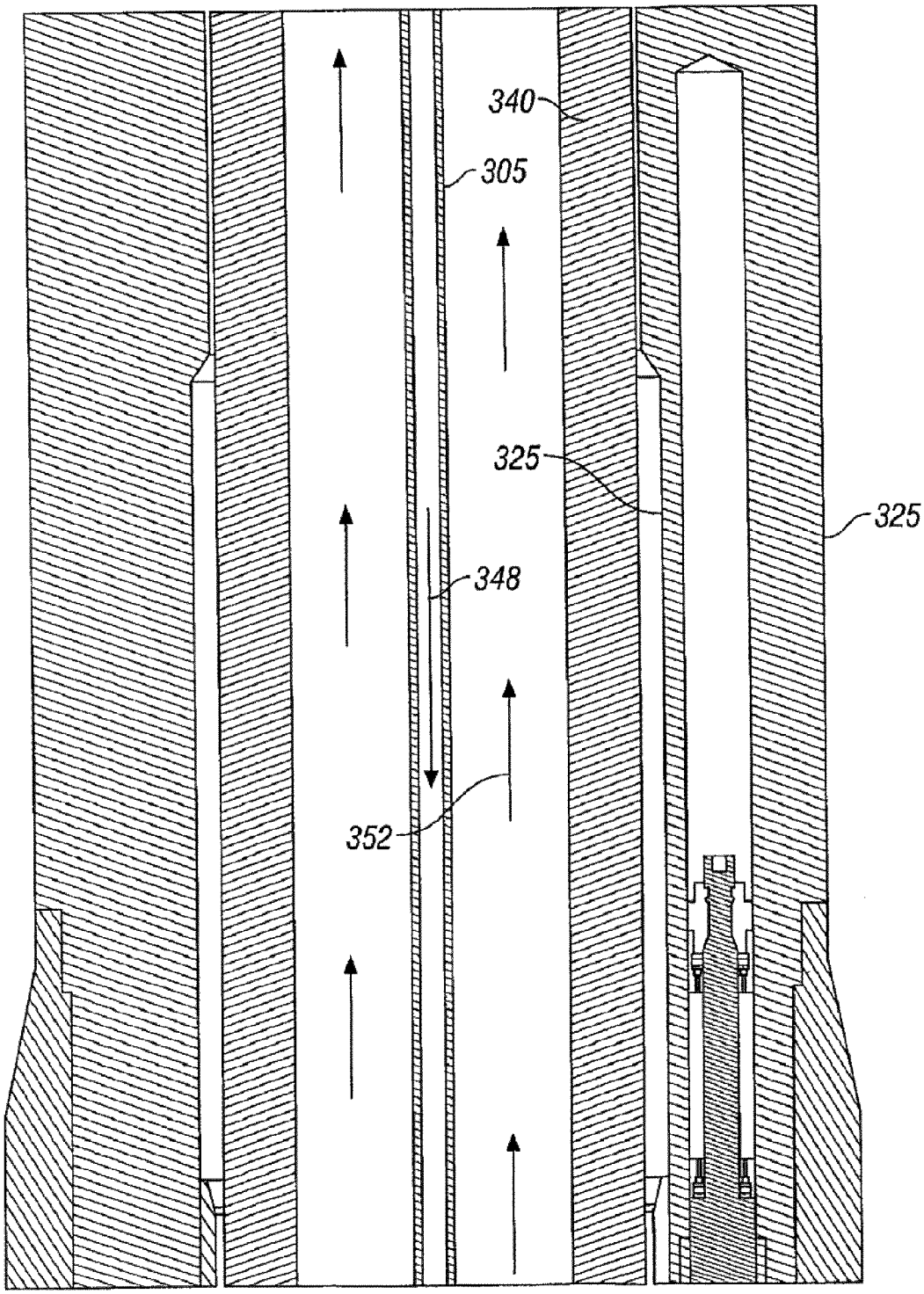
Figures 3, 4:
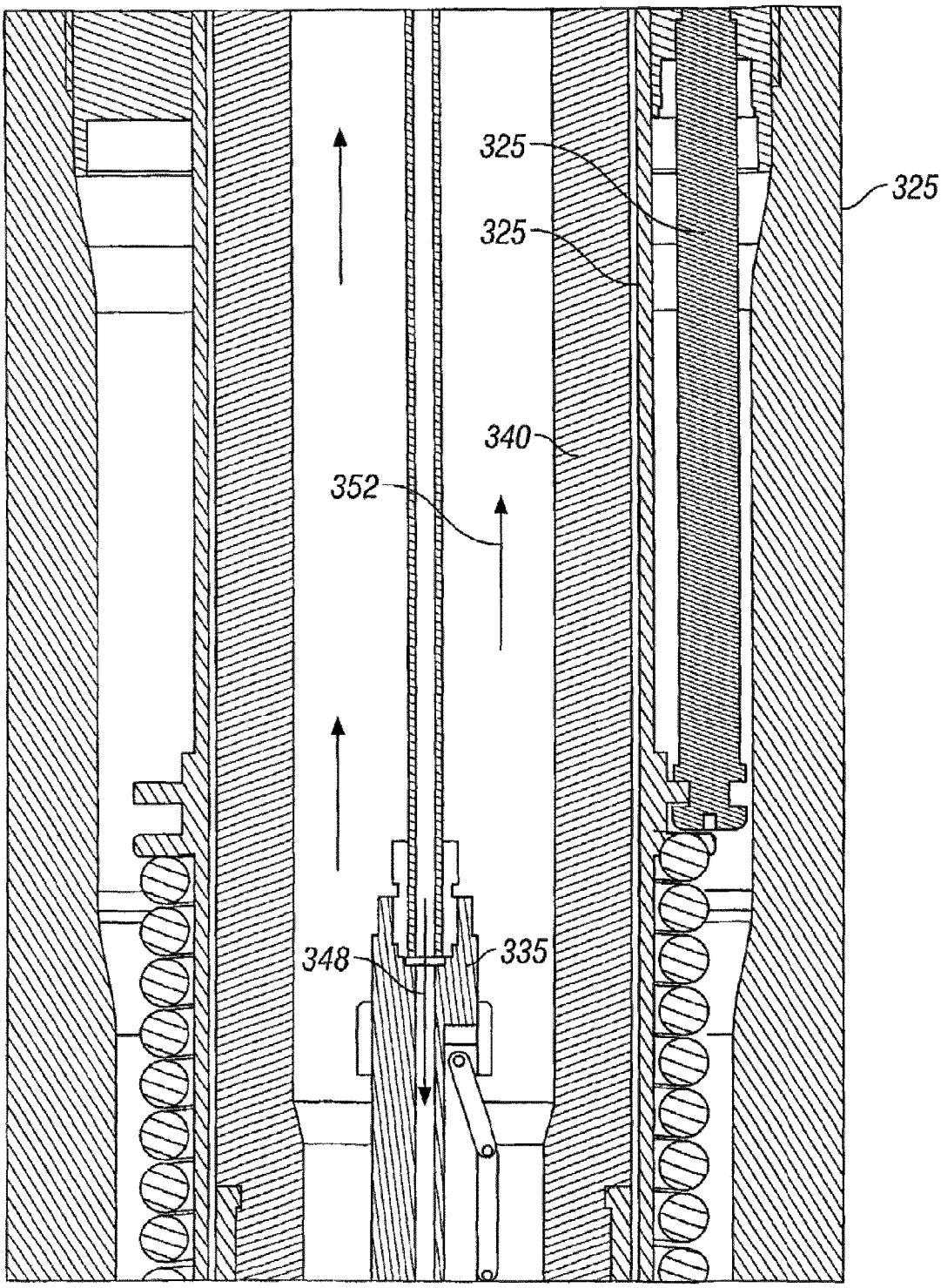
Figures 3, 4, 5:
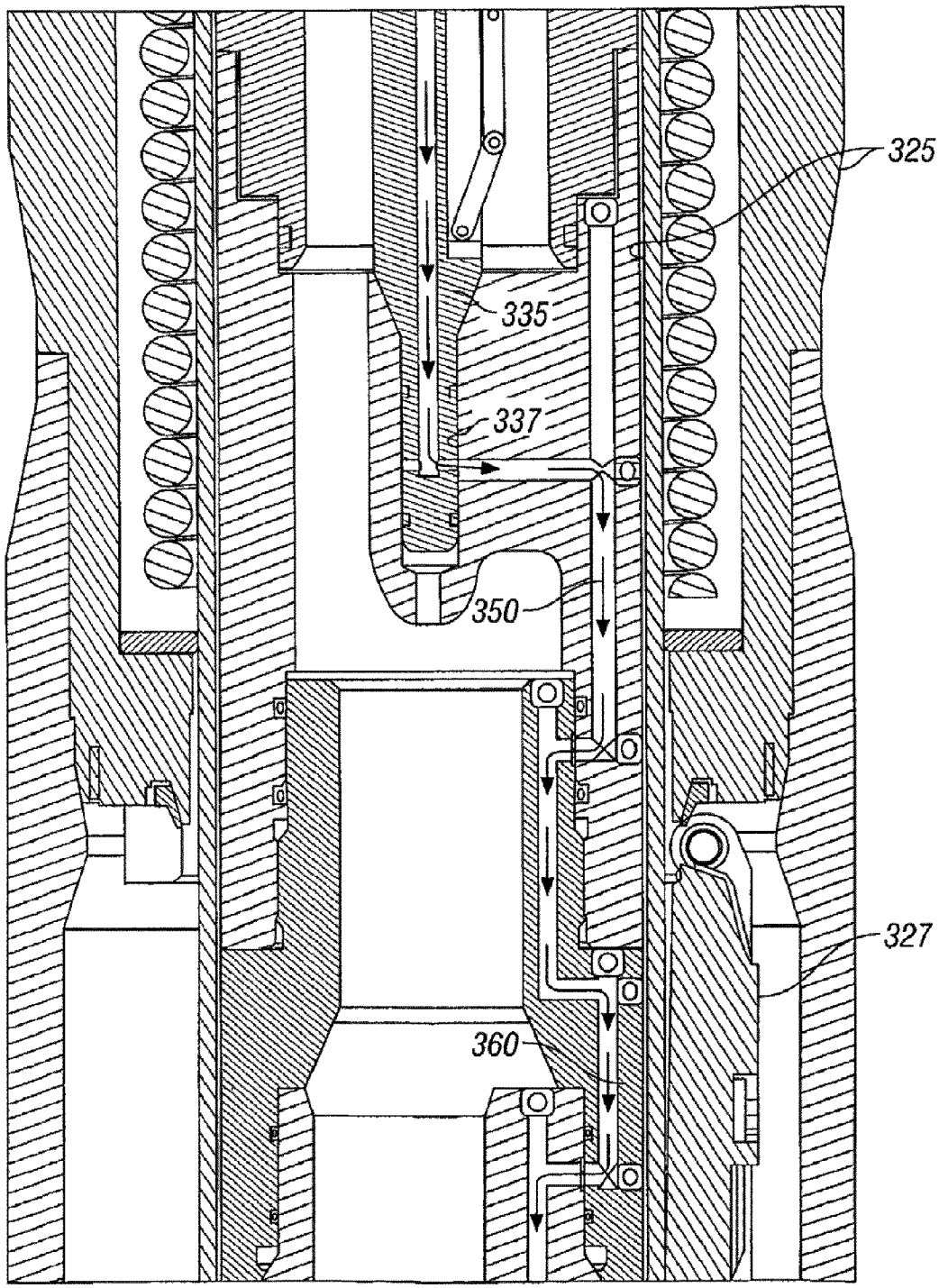
Figures 3, 4, 5, 6:
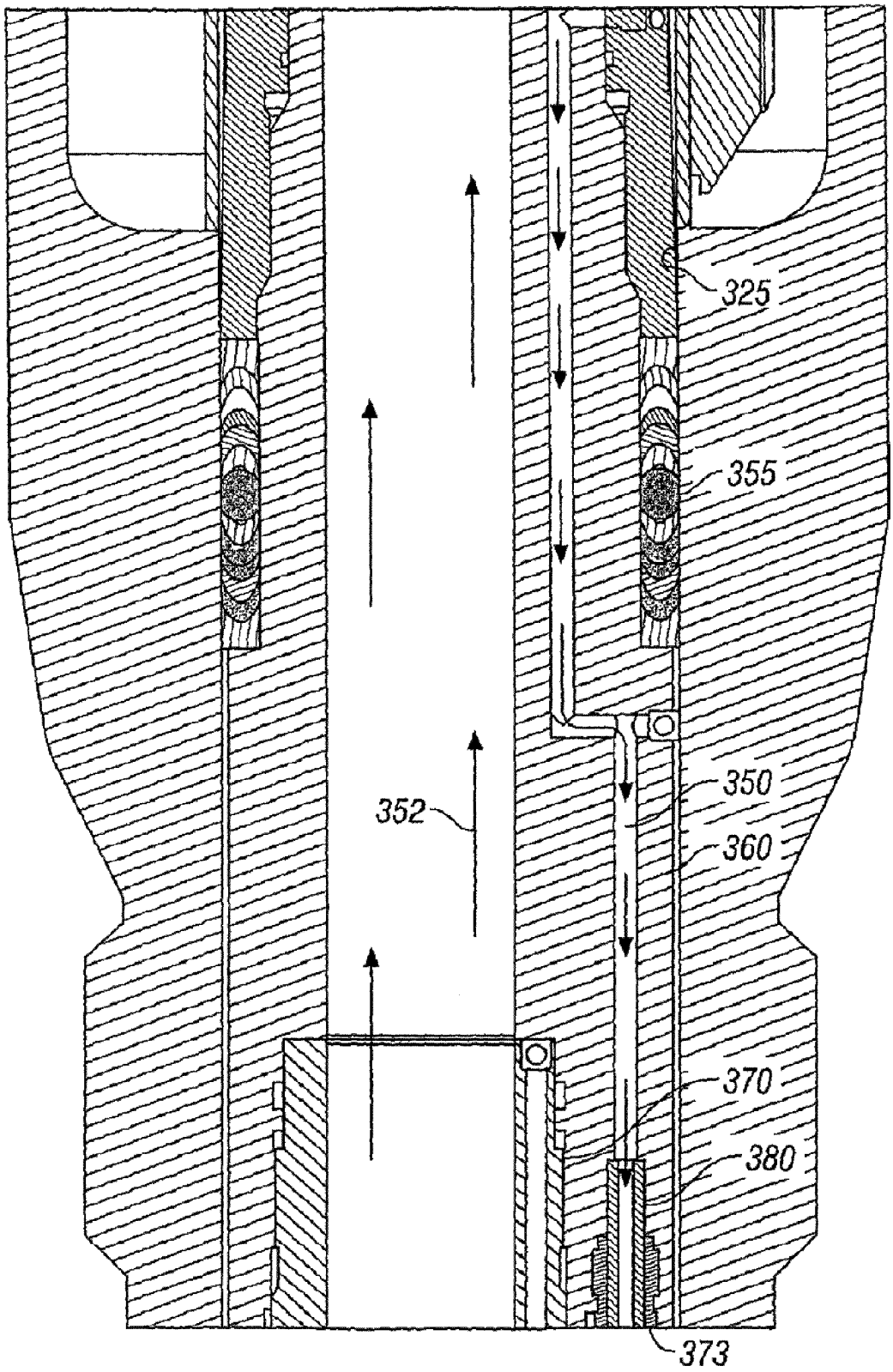
Figures 3, 4, 5, 6, 7:
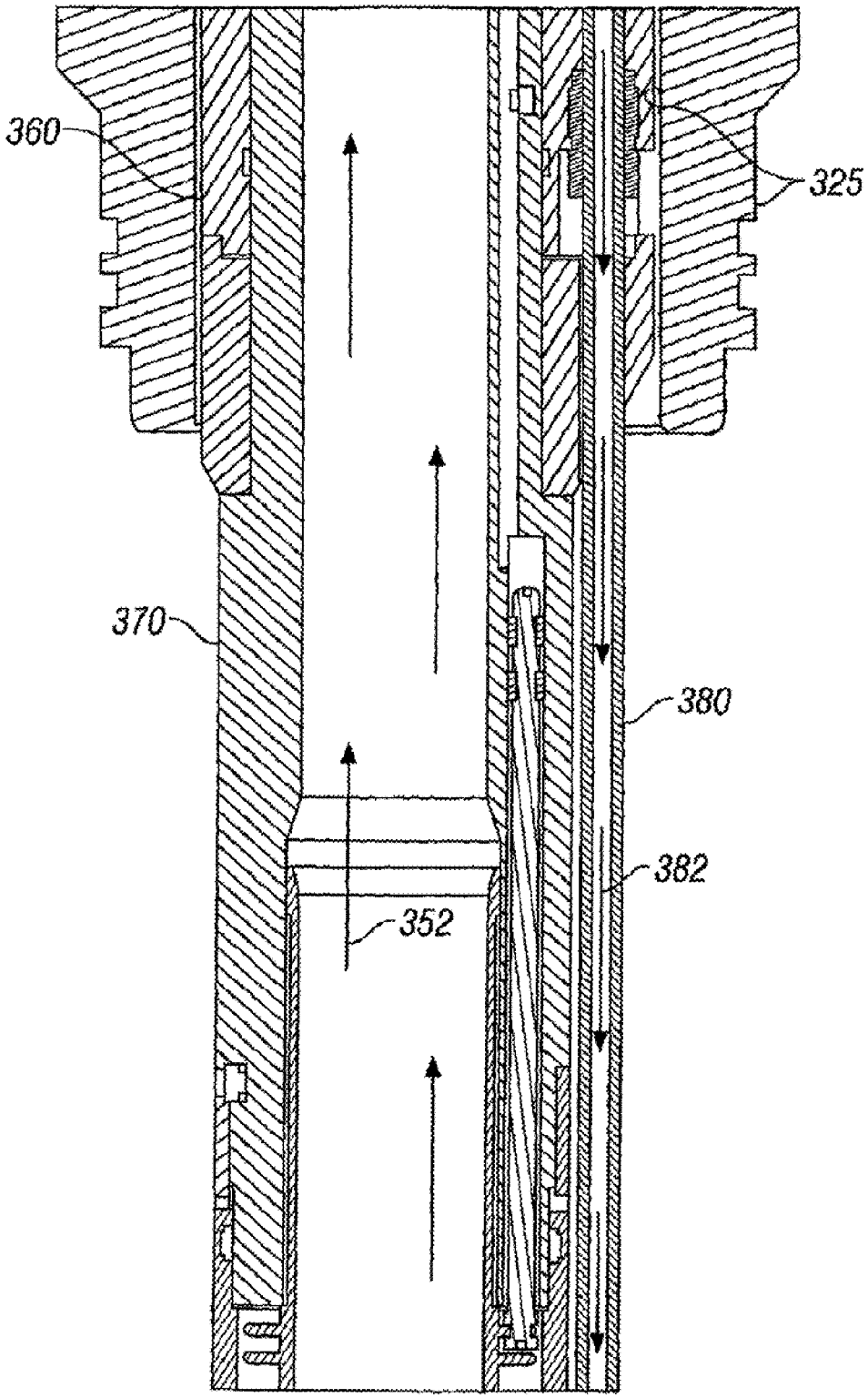
Figures 3, 4, 5, 6, 7, 8:
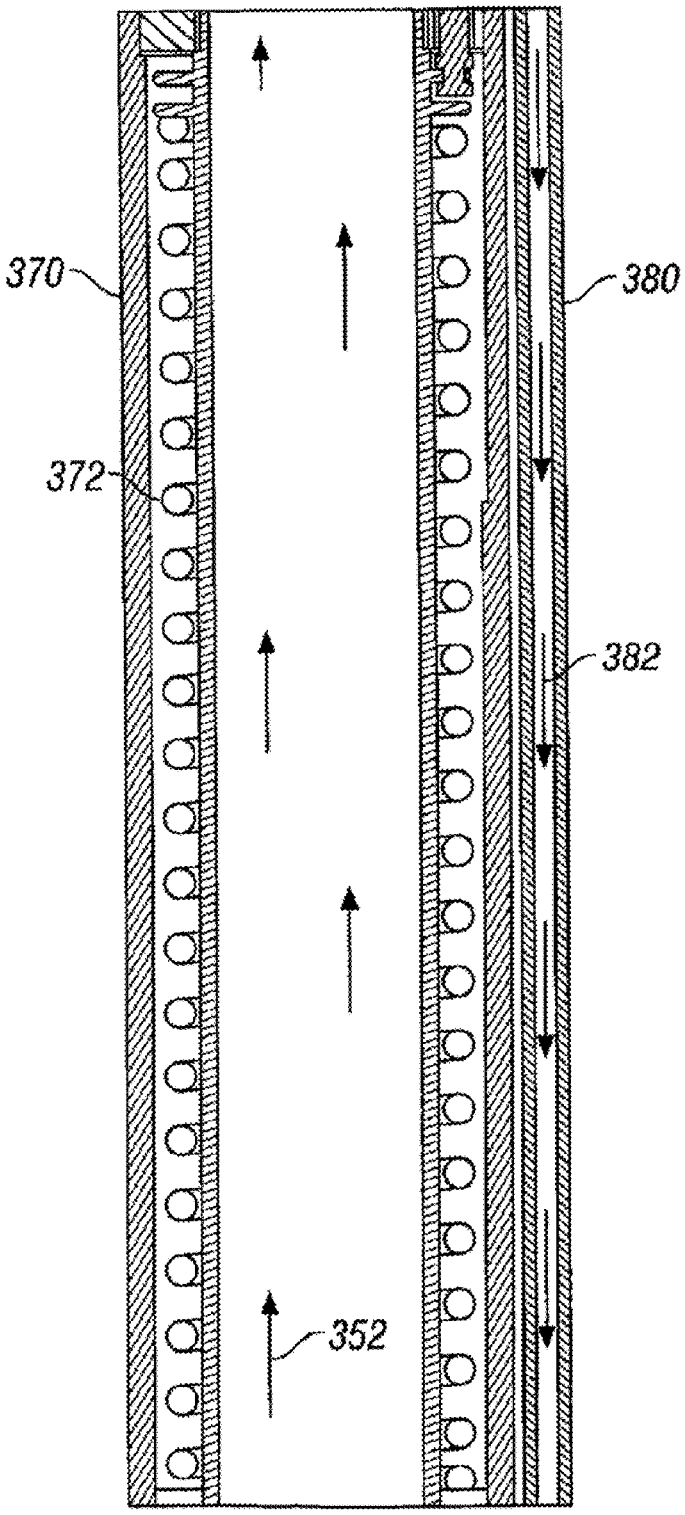
Figures 3, 4, 5, 6, 7, 8, 9:
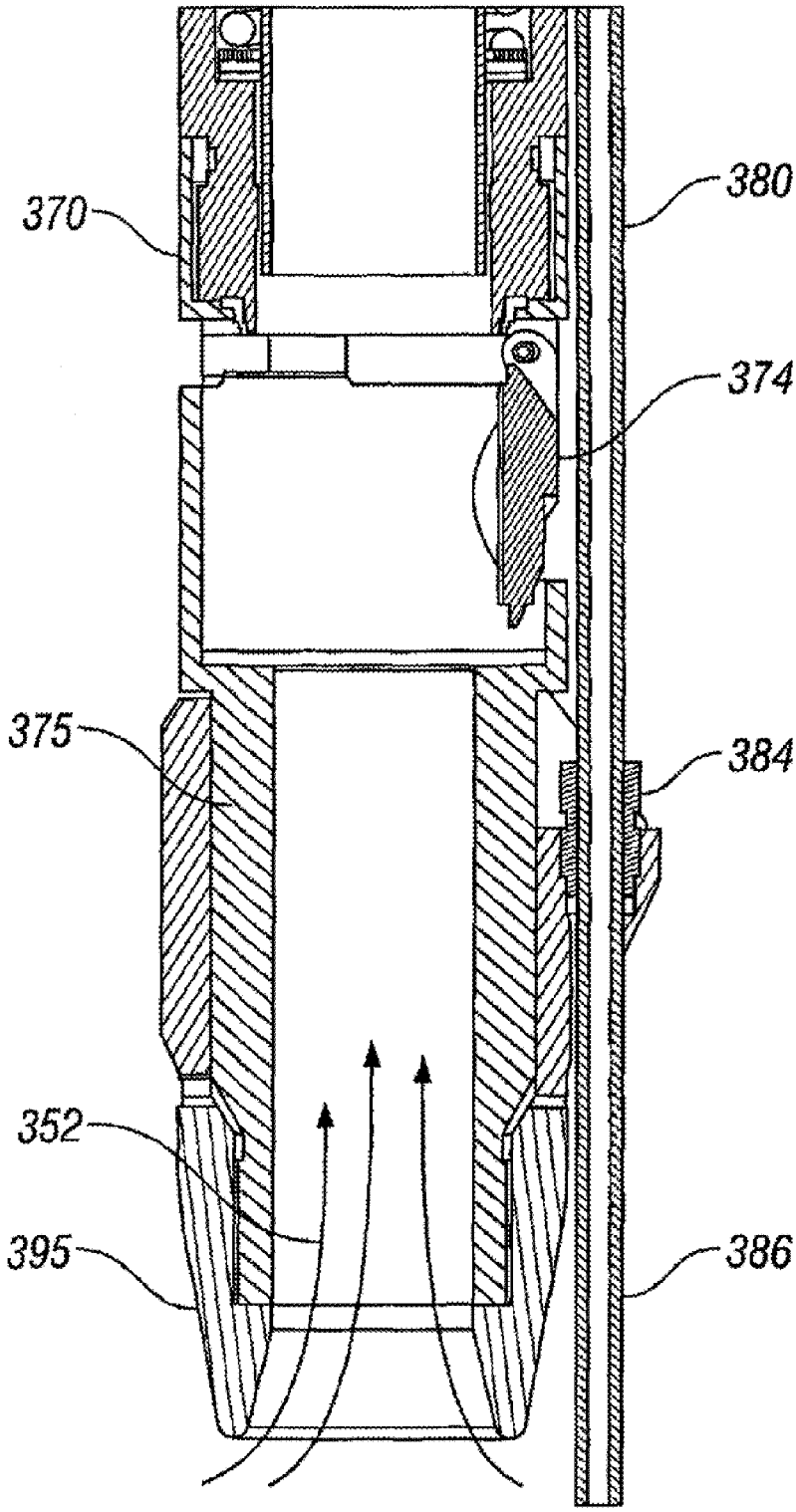
Figure 4A:
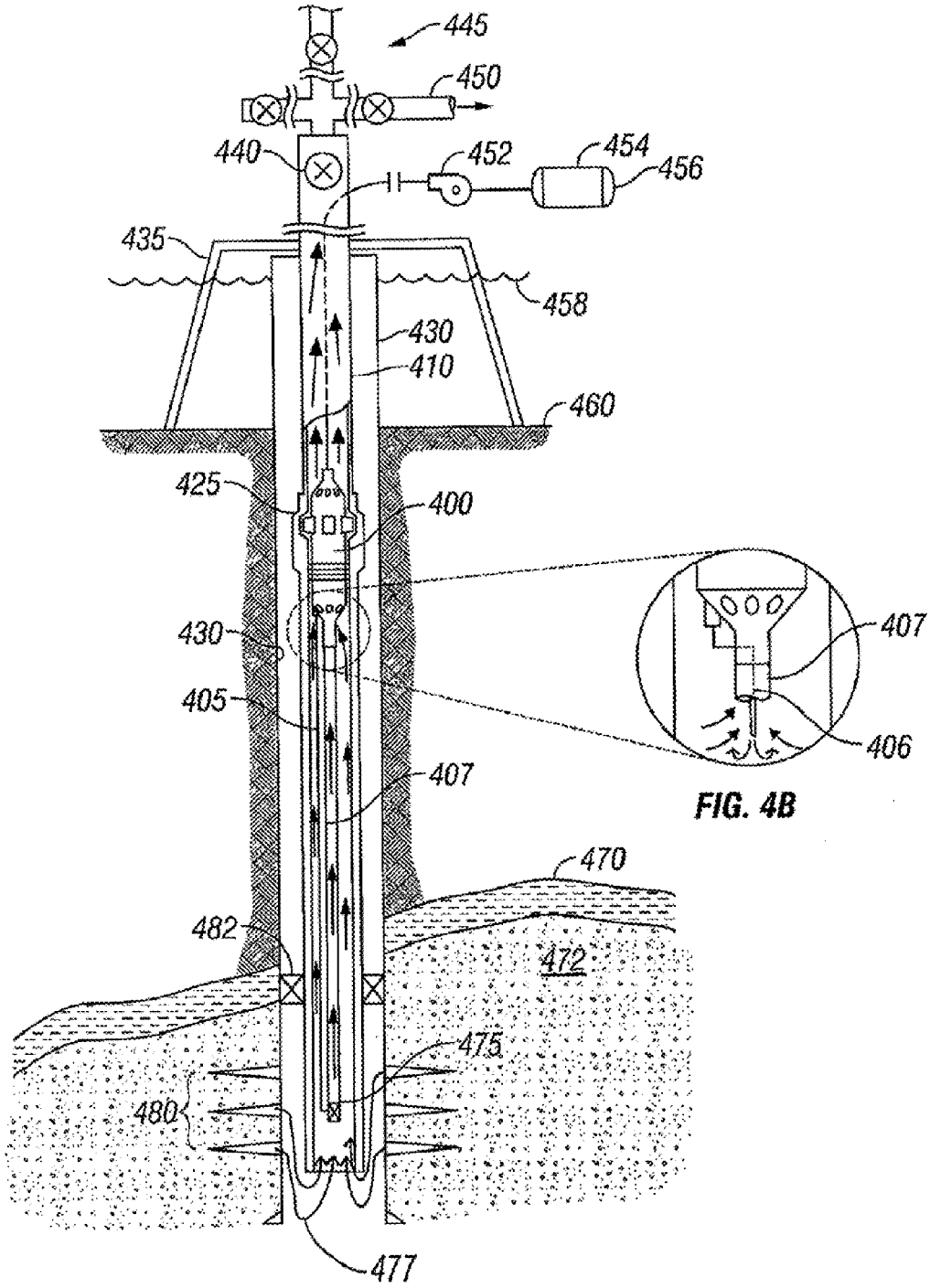
FIG. 4A is a schematic view of another embodiment of the present application depicting a velocity tubing string having a gas lift valve for regulating injection flow deployed in a well and hung from an enhanced WRSCSSV, a bypass passageway is external the velocity tubing string.
Figure 5:
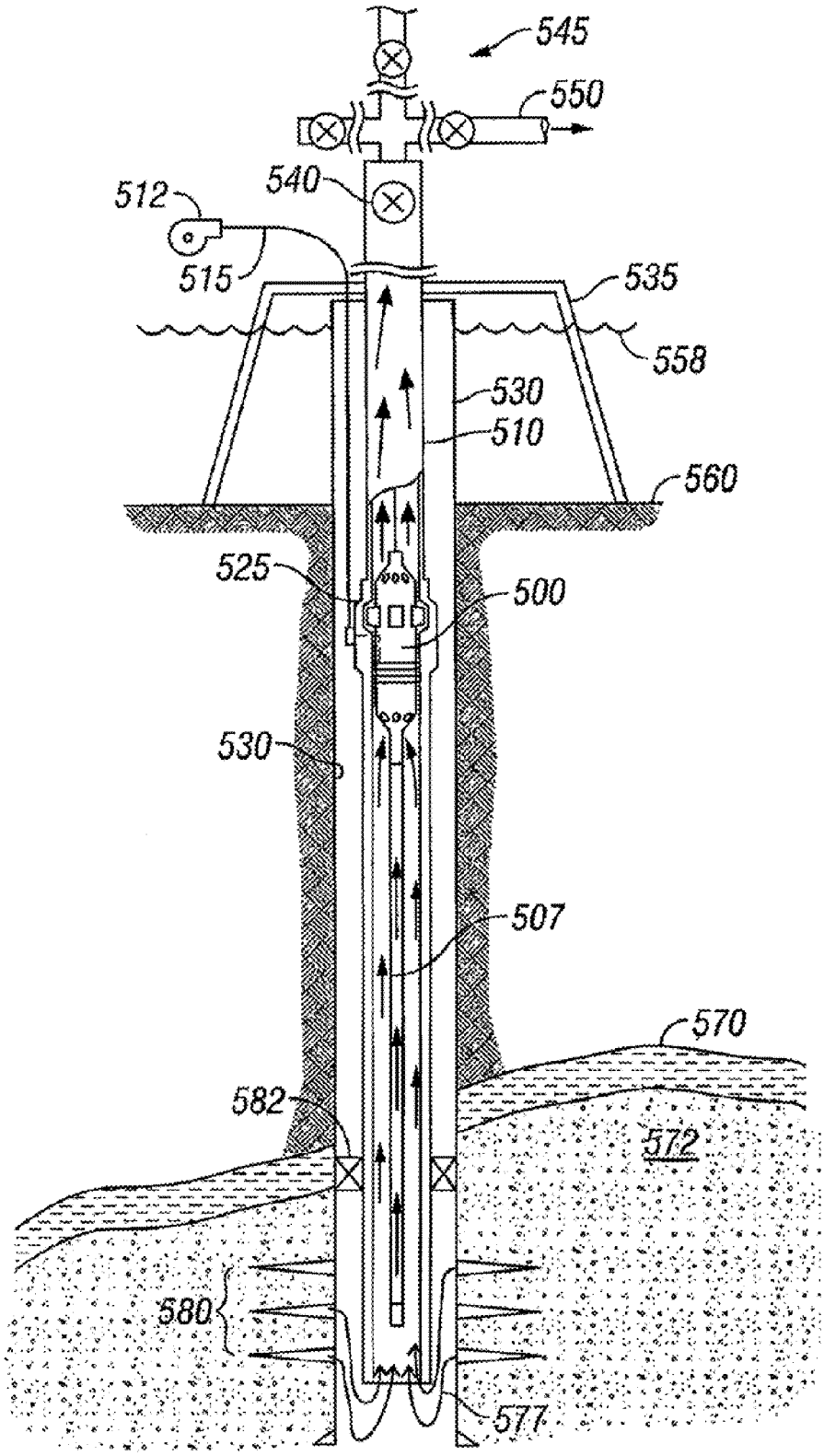
Figure 6:
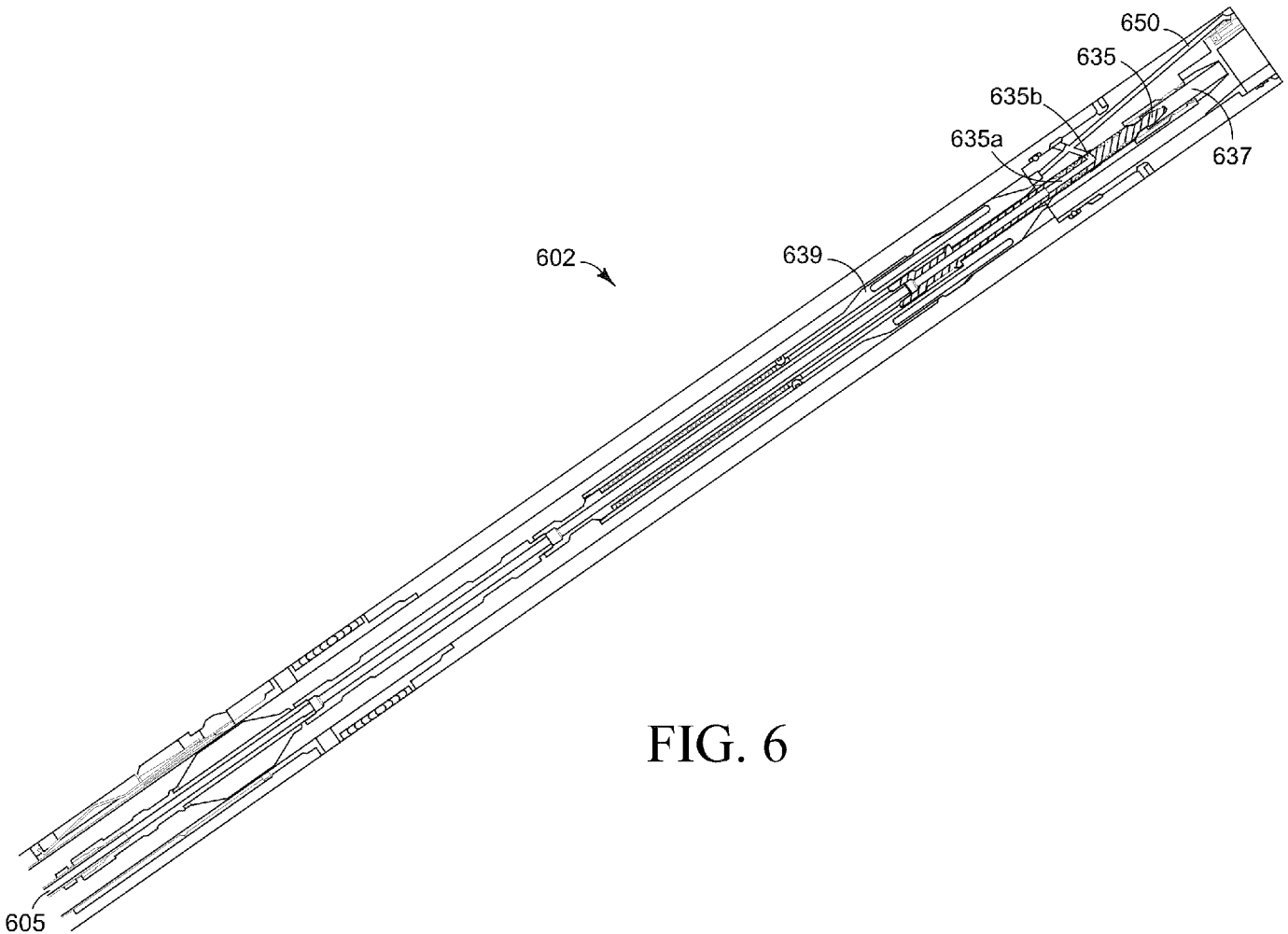

FIG. 4A depicts an alternate embodiment where the enhanced WRSCSSV 400 includes a tubing stinger hanger utilized to suspend a tubing string 407. In one embodiment, the tubing string 407 is a velocity tubing string. The details of the enhanced valve 400 are similar to that shown in previous embodiments except the lower adapter (175 in FIG. 1, 275 in FIG. 2A-2B, 375 in FIG. 3-7) is modified to include a tubing string hanger. Similarly, optional flow nozzle 395 in FIG. 3-9 can be modified to include a tubing string hanger to hang a tubing string 407 down the wellbore.

Starting at the top, FIG. 4A depicts an offshore platform 435. Offshore platform 435 further comprises a wellhead 445 containing a production flow line 450 to remove the produced fluids 477 from the well. While an offshore platform is described, one of ordinary skill in the art would recognize that the concepts are equally applicable to any other type of well. In addition, the well contains a master valve 440 allowing injection of lift gas 454 from reservoir 456 through compressor 452. Master valve 440 can be any type, including, but not limited to, the master valve of the invention described in U.S. Provisional Application Ser. No. 60/595,137, filed Jun. 8, 2005 by Jeffrey Bolding and Thomas Hill entitled "Wellbore Bypass Method and Apparatus" and U.S. patent application Ser. No. 11/916,985, filed Jun. 8, 2006 by Jeffrey Bolding and Thomas Hill filed entitled "Wellhead Bypass Method and Apparatus", both hereby incorporated by reference.

The master valve 440 is connected to production tubing 410. Production tubing 410 extends below the surface of the water 458 and is disposed within a casing string 430. Below the mudline 460, an enhanced valve 400 can be installed in the production tubing 410 at a nipple profile of the production tubing 410 and/or TRSCSSV 425. Lower capillary tubing 405 and velocity tubing string 407 are thus suspended from the enhanced WRSCSSV 400, which is typically anchored into nipple profile of production tubing or the nipple profile of TRSCSSV 425 as shown here.

Hydrocarbon producing formation 472 and perforations 480 allow produced fluid 477 to flow from the formation 472. The flow of hydrocarbons (e.g., produced fluid 477) can be induced by artificial gas lift injected through the lower capillary tube 405. Although not shown, distal end of lower capillary tube 405 can merely extend within the production tubing 410, typically to a depth adjacent to the perforations 480. In the illustrated embodiment, the distal end of lower capillary tube 405 connects to a gas lift valve 475 attached to velocity tubing string 407. So configured, the injected gas flows through velocity tubing string 407 and aids the lifting of produced fluids 477 through the velocity tubing string 407 and through the enhanced WRSCSSV 400 to the bore of production tubing 410. Although ports are illustrated on the distal end of the enhanced WRSCSSV 400, in this embodiment they are not required and can be closed so that the produced fluids 477 flow through velocity tubing string 407 into the enhanced WRSCSSV 400, out the ports on the proximal end of enhanced WRSCSSV 400, through the production tubing 410 and out production flow line 450.

Gas lift valve 475 controls the flow of the injected gas through the lower capillary tube 405. As the bypass passageway (not shown) allows the operation of the closure member (e.g., flapper disc) of an enhanced WRSCSSV 400 to be maintained, an operator can inject gas independent of the position of the closure member to aid in the lifting of produced fluids 477 through the velocity string 407 via the bypass passageway (not shown) of the enhanced WRSCSSV 400. While gas lift is depicted in FIG. 4, one of ordinary skill in the art would recognize that embodiments of the present application can be used as a velocity string hanger while injecting other fluids such as surfactants, scale inhibitors, corrosion control chemicals, etc.

Although FIG. 4A depicts production fluid 477 flowing into both the velocity tubing string 407 and the production fluid 477 in the outer annulus formed between the velocity string 407 and the production tubing 410 flowing into the optional ports in distal end of enhanced WRSCSSV 400, one of ordinary skill in the art will recognize that either flow path (e.g., optional ports and velocity tubing string 407) can be used and it is not limited to utilizing both as shown. The smaller profile of velocity tubing string 407 as compared to production tubing 410 and/or the injection of gas can increase the annular velocity of production flow, and thus production.

An alternate embodiment is depicted in the inset FIG. 4B wherein the lower capillary tube 406 extends within the bore of the velocity tubing string 407, as opposed to extending external to the velocity tubing string 407 as shown in FIG. 4A. Enhanced WRSCSSV 400, for example, the lower adapter and/or velocity tubing string 407 can be modified to reroute the injected fluid through the velocity tubing string 407. In FIG. 4B, the lower capillary tube 406 is rerouted into the bore of the velocity tubing string 407. This embodiment can be used if concentric tubes are desired, for example, to avoid damage of the lower capillary tube 406 by housing it within the velocity flow tubing 407. Concentric tubes can be formed as a unitart assembly. The concentric tubes embodiment of FIG. 4B enables the same operation as the embodiment in FIG. 4A without requiring two separate injection and velocity tubes.

FIG. 5 depicts an alternate embodiment where the enhanced WRSCSSV 500 includes a tubing hanger to suspend a velocity tubing string 507 without injecting gas or other fluids. The details of the enhanced valve 500 are similar to that shown in previous embodiments, however no upper or lower capillary tubing is installed. In one embodiment, enhanced WRSCSSV 500 includes a locking mandrel, a bypass passageway extending between an upper and lower adapter, wherein the lower adapter includes a tubing string hanger.

Starting at the top, FIG. 5 depicts an offshore platform 535 that includes a wellhead 545 containing a production flow line 550 to remove the produced fluids 577 from the well. While an offshore platform is described, one of ordinary skill in the art would recognize that the concepts are equally applicable to any other type of well. The master valve 540 is connected to production tubing 510. Production tubing 510 extends below the surface of the water 558 and is protected by casing 530. Below the mudline or seabed 560, an enhanced WRSCSSV 500 is installed in the production tubing 510 in a nipple profile, for example a nipple profile in the production tubing 510 or in a TRSCSSV 525. Velocity tubing string 507 is suspended from a tubing string hanger connected to enhanced WRSCSSV 500.

The hydrocarbon producing formation 572 and perforations 580 allow produced fluid 577 to flow from the formation 572. The flow can be lifted by standard techniques known in the art such as gas lift through the through the velocity tubing string 507 and up through the enhanced valve 500 to the production tubing 510. Pump 512 and hydraulic control line 515 connect to the closure member of the enhanced WRSCSSV 500 to allow actuation thereof.

Although FIG. 5 depicts production fluid 577 flowing into the velocity tubing string 507 and the production fluid 577 in the outer annulus formed between the velocity string 507 and the production tubing 510 flowing into the optional ports in distal end of enhanced WRSCSSV 500, one of ordinary skill in the art will recognize that either flow path (e.g., optional ports and velocity tubing string 507) can be used and it is not limited to utilizing both as shown. The smaller profile of velocity tubing string 507 as compared to production tubing 510 and/or the injection of gas can increase the annular velocity of production flow.

FIG. 6 illustrates a wellbore injection system 602, according to an embodiment of the present disclosure. Injection system 602 includes an injector isolation mechanism that allows an injector flowpath 635*a* to be substantially isolated from wellbore pressures. As is well known in the art, surface exposure to wellbore pressures can be dangerous due to conditions, such as relatively high wellbore pressures and/or hazardous gas environments that exist in the wellbore. Referring to FIG. 3-5, during installation of the injector into the wellbore, the operators on the surface can be exposed to these hazardous conditions via the injector 335 and capillary tube 305 (shown in FIG. 3-1) when, for example, the WRSCSSV is not functioning properly. Thus, the injector isolation mechanism of injection system 602 can provide a secondary safety barrier, in addition to the WRSCSSV, that can reduce the risk of exposing surface operators to dangerous wellbore conditions.

Wellbore injection system 602 includes a capillary tube 605 positioned in a subsurface wellbore so as to allow fluid communication through the wellbore. An injector 635 comprises an injector flow path 635*a* and an injector flow path opening 635*b*. Injector 635 is attached, either directly or indirectly, to capillary tube 605 so as to provide fluid communication from the capillary tube 605 through the injector flow path 635*a* and injector flow path opening 635*b*.

A receptacle 637 capable of receiving injector 635 is also positioned in the wellbore. Receptacle 637 is in fluid communication with bypass passageway 650, which can be similar to other bypass passageways described herein in that it can allow injection of a fluid around a WRSCSSV. Injector 635 is capable of being removably attached to receptacle 637 to provide fluid communication between the capillary tube 605 and the bypass passageway 650 through injector flow path 635*a*.

As more clearly shown in FIGS. 7A to 7D, injector 635 can include one or more seals 636 that are designed to reduce leakage of a fluid flowing between injector flow path 635*a* and the bypass passageway 650. Seals 636 can be positioned on one or both sides of injector flow path opening 635*b*. Any suitable type of seals can be employed, such as, for example, O-rings. Where seals 636 are included as part of injector 635, they can also help to provide a seal between the injector 635 and an isolation mechanism 638, described in detail below, and thereby improve isolation of the injector flow path 635*a* from wellbore pressure when isolation mechanism 638 is positioned to block injector flow path opening 635*b*. In another embodiment, seals (not shown) can be provided as part of the receptacle 637 and/or the isolation mechanism 638, either in place of or in addition to the seals 636 included as part of injector 635, so as to provide the desired isolation of the injector flow path opening 635*b*.

Figure 7A:
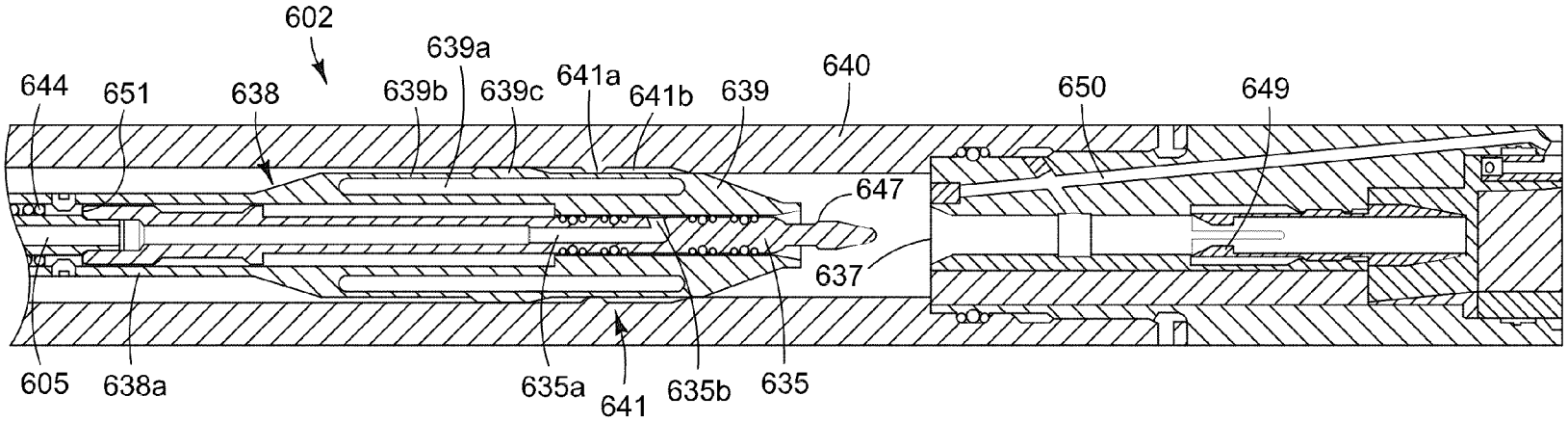
FIG. 7A to 7D illustrate cross-sectional views of a wellbore injection system, according to an embodiment of the present disclosure.

As shown in FIG. 7A, isolation mechanism 638 comprises a tubular member 638*a* slideably attached to the injector 635. The injector 635 can move back and forth inside of the tubular member 638*a* between a first position (see FIGS. 7A and 8A) in which the tubular member blocks the injector flow path opening 635*b* to isolate the injector flow path 635*a* from the wellbore pressure; and a second position (see FIGS. 7D and 8B) in which the tubular member 638*a* does not block the injector flow path opening 635*b*.

One or more wings 639 can be attached to the tubular member 638*a*. In an embodiment, two, three, four or more wings 639 can be employed. A gap 639*a* can be positioned in the wing 639 so as to form a flexible wing member 639*b*. A wing retaining profile 639*c* can be formed as part of the flexible wing member 639*b*. A corresponding tube profile 641 can be formed in the spacer tube 640. Spacer tube profile 641 can include, for example, a protrusion 641 a and a groove 641*b*. The flexible wing member 639*b* and wing retaining profile 639*c* can function as a retaining mechanism 642 (shown in FIG. 7C) with the tube profile 641 to hold the isolation mechanism 638 substantially in place relative to the spacer tube 641.

Figure 7B:
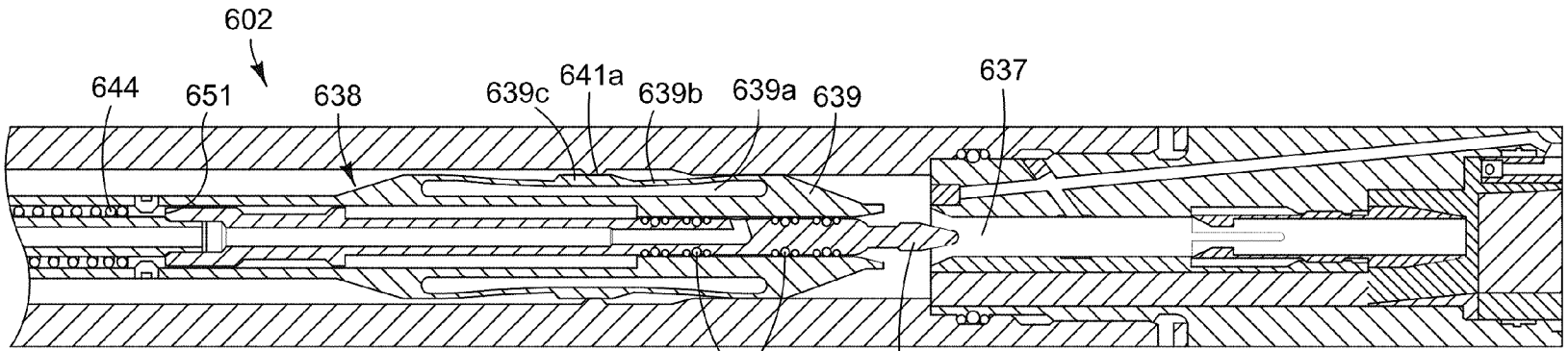
Figure 7C:
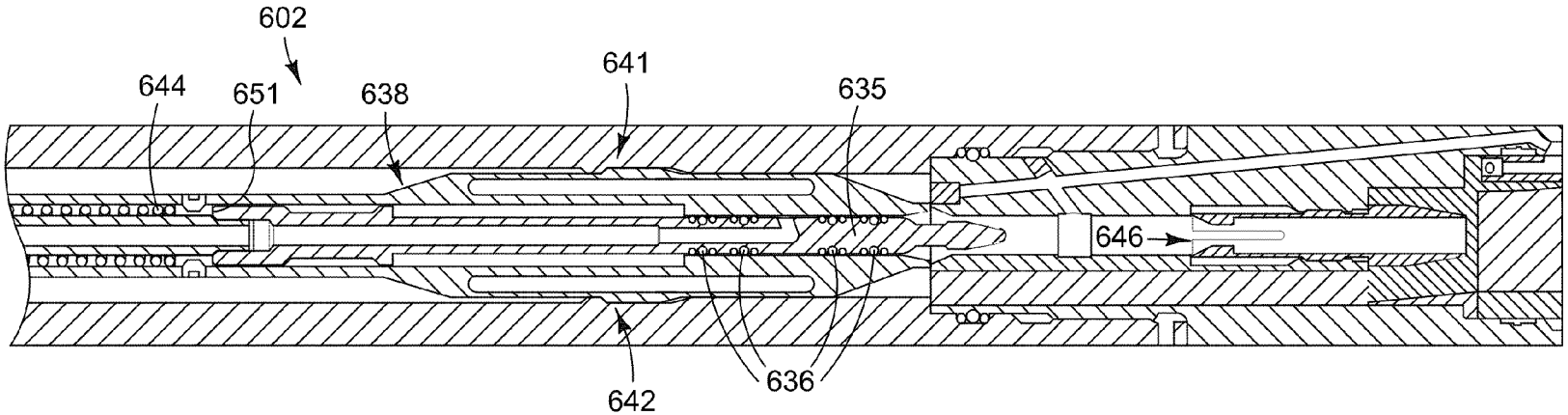

For example, as shown in the embodiment of FIG. 7A to 7D, wing member profile 639*b* can be angled to have a more gradual taper on a down-hole side and a relatively less gradual taper on the up-hole side of the profile. Referring to FIG. 7B, as the wing 639 passes the protrusion 641*a*, the flexible wing member 639*b* deflects inward to allow the wing retaining profile 639*c* to clear the spacer tube profile 641, the gradual taper of the wing retaining profile 639*c* allowing it to more easily slide past protrusion 641*a* in the down-hole direction. After wing retaining profile 639*c* clears protrusion 641*a*, the flexible wing member springs back in a radially outward direction to move wing retaining profile 639*c* into groove 641*b*, which can be designed to hold wing retaining profile substantially in place relative to spacer tube 640 and the wellbore, as illustrated in FIG. 7C.

Figure 7D:
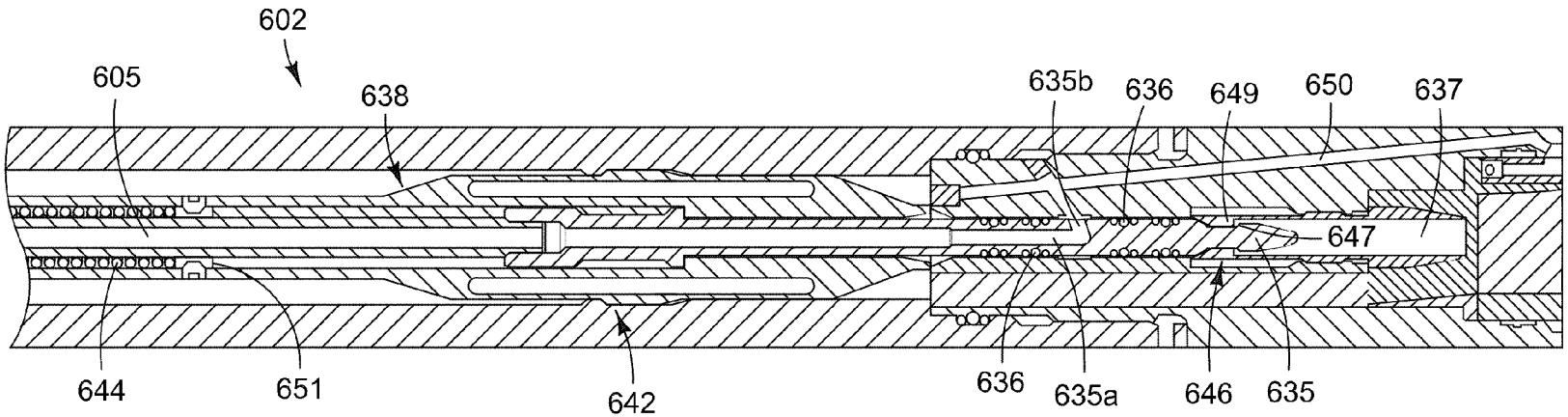

The retaining mechanism 642 allows the injector 635 to move relative to the isolation mechanism 638, so that while wing 639 is held in place, injector 635 can continue in a down-hole direction to engage receptacle 637, as illustrated in FIG. 7D.

A second retaining mechanism 646 can be employed for holding the injector 635 substantially in place relative to the receptacle 637. In an embodiment, the second retaining mechanism 646 comprises a shoulder profile 647 in the injector 635 that is capable of engaging one or more collet fingers 649 attached to the receptacle 637.

Figure 8A:
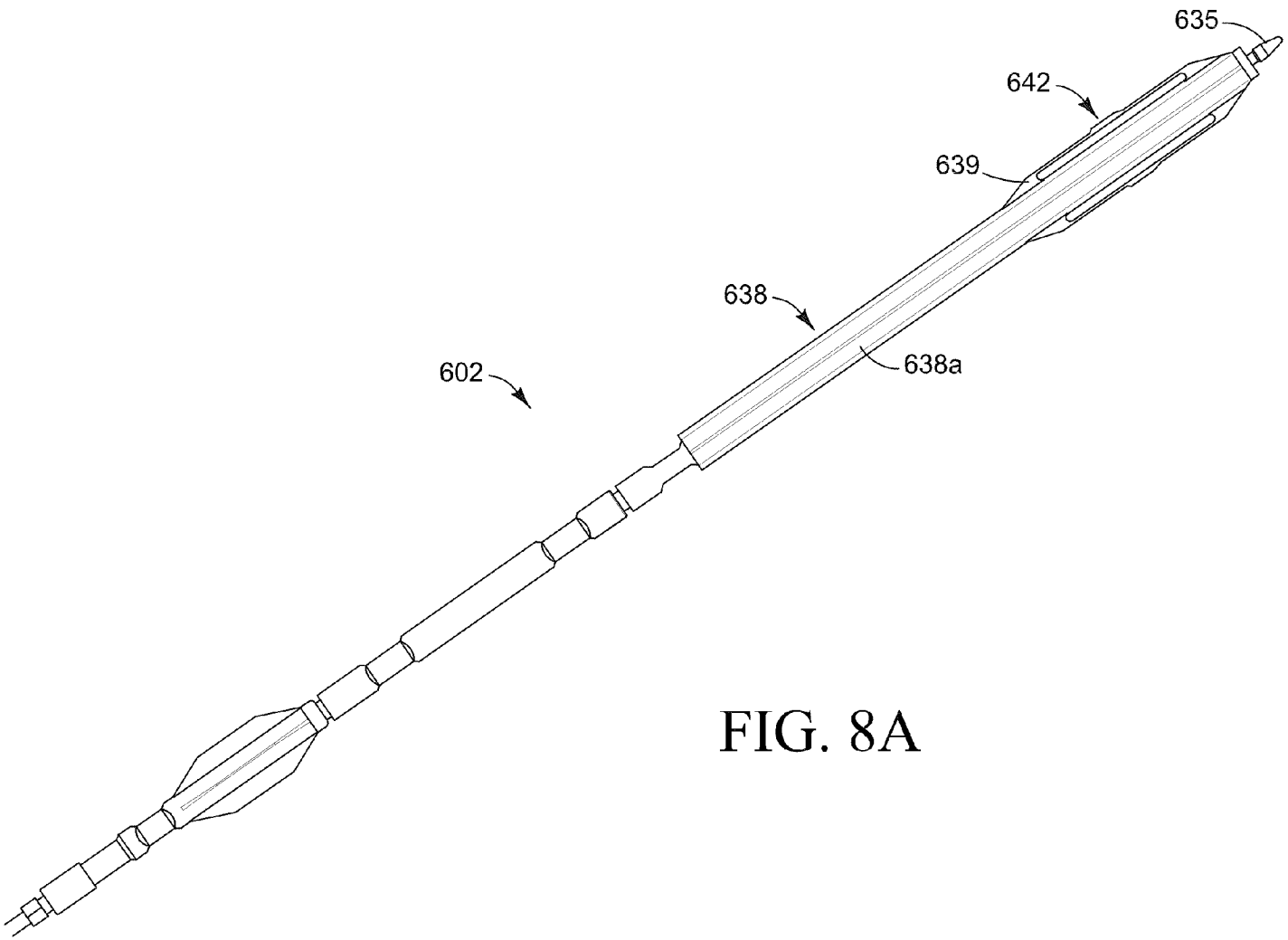
FIGS. 8A and 8B illustrate schematic views of a wellbore injection system, according to an embodiment of the present disclosure.
Figure 8B:
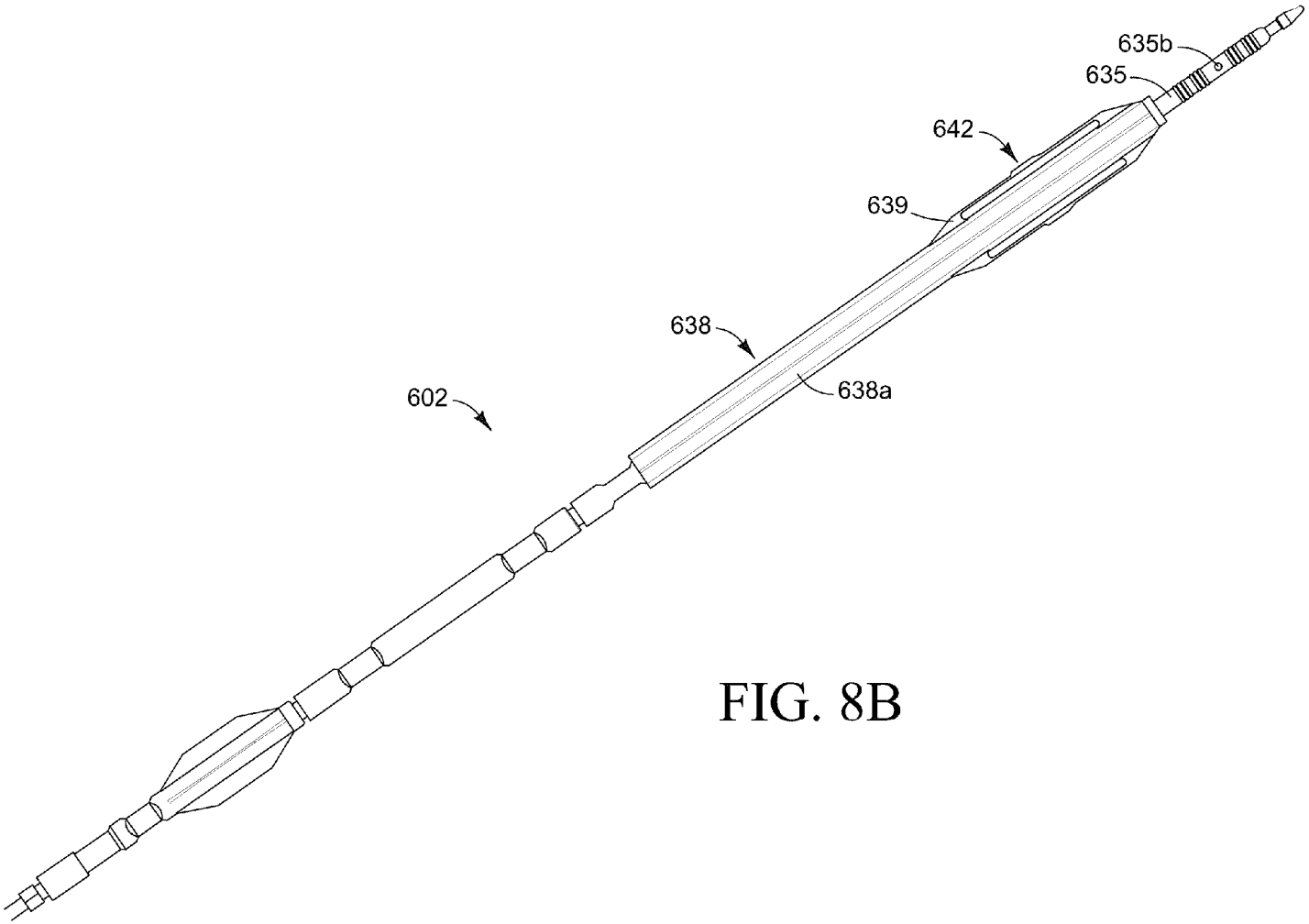

Wellbore injection system 602 further comprises a biasing mechanism 644 proximate the isolation mechanism 638. Any suitable biasing mechanism can be employed, such as, for example, a spring. The biasing mechanism 644 can act on the isolation mechanism 638 to force it into a desired position so as to block injector flow path 635*a*, thereby automatically isolating the capillary tube 605 from the wellbore pressure when the injector 635 is not attached to the receptacle 637. Thus, for example, biasing mechanism 644 can apply a force to the tubular member 638A that tends to move the tubular member 638A into the first position, as illustrated in FIGS. 7A and 8A.

In addition to biasing mechanism 644, retaining mechanism 642 can also act as a mechanical means for forcing isolation mechanism 638 into the first position when removing injector 635 from receptacle 637. This is because the less gradual angle positioned on the up-hole side of wing member profile 639*b* can make it relatively difficult for wing 639 to move in an up-hole direction. Thus, the wing 639 is held in place as the injector 635 is removed from the receptacle 637, thereby forcing isolation mechanism 638 from the second position, as shown in FIG. 7D, into the first position relative to injector 635, as shown in FIG. 7C.

As the injector 635 is moved into the first position, it is forced up against a shoulder 651, which is fixed relative to the isolation mechanism 638. The up-hole force on the injector 635 is then transferred directly to the isolation mechanism 638, which in turn provides sufficient force to move wing member profile 639*b* up past the spacer tube profile 641. In this manner, the retaining mechanism 642 helps to insure that the isolation mechanism 638 is positioned to isolate the injector flow path 635*a* from wellbore conditions as the injector 635 is removed from the wellbore.

A second set of wings 652 can be included as part of the wellbore injection system 602, as illustrated in the embodiment of FIG. 6. Wings 652 can function to keep the wellbore injection system 602 relatively centered in spacer tube 640. Wings 652 can also function to improve alignment of the injector 635 with the receptacle 637 during the injection process.

Figure 9A:
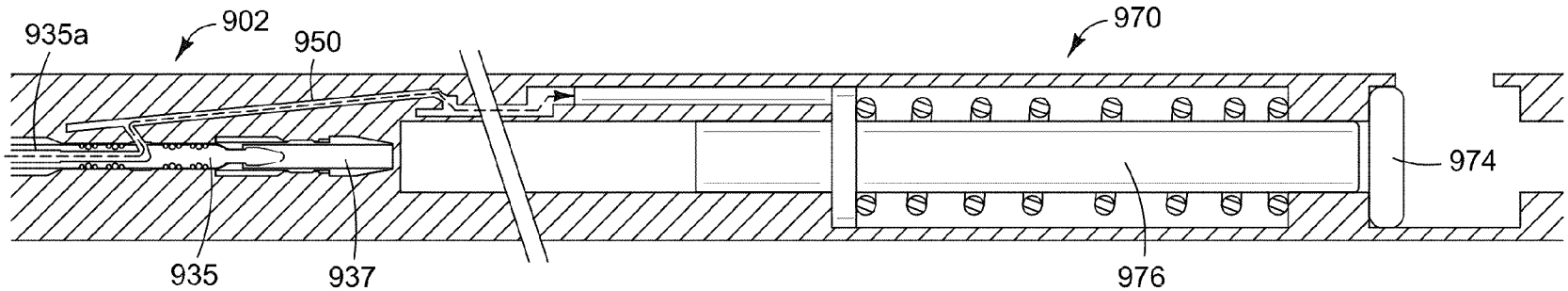
FIGS. 9A and 9B illustrate an embodiment of the present disclosure wherein an injector is employed to inject hydraulic oil to operate a valve.
Figure 9B:
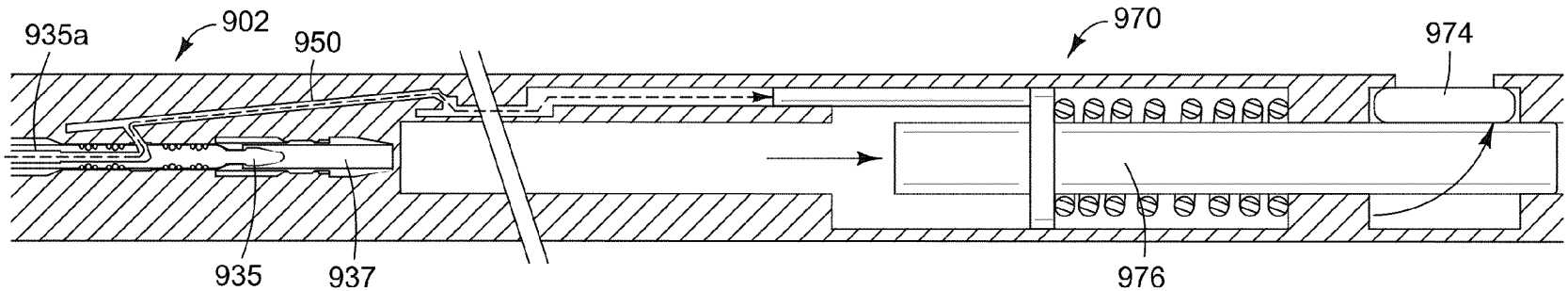

FIGS. 9A and 9B illustrate an embodiment of the present disclosure wherein an injector is employed to inject hydraulic oil to operate a valve, such as the wireline safety valves described herein. This hydraulic oil injection system can be used in the event that, for example, a tubing valve control line fails, and an alternate system for actuating the valve is therefore desired. FIG. 9A shows the valve in closed position; and FIG. 9B shows the valve in open position.

Referring to FIG. 9A, a wellbore injection system 902 in combination with a wireline valve 970 are shown. The wellbore injection system 902 includes an injector 935 and a receptacle 937; and is otherwise similar to wellbore injection system 602 (FIGS. 6 to 7D), except that wellbore injection system 902 does not have a bypass passageway. Instead, wellbore injection system 902 has a hydraulic passageway 950 for controlling a valve 970.

Valve 970 can be any suitable WR valve that can be controllable by hydraulic fluid, such as the wireline safety valves described herein. The injection system 902 and the WR valve can be deployed, for example, in the event a tubing valve control line fails. The system 902 can be placed inside the tubing valve or other nipple. Any suitable method for deploying the injection system can be used, including any of the methods discussed herein for deploying WR valves.

After injection system 902 is deployed, the injector 935 can be inserted into the receptacle 937. Subsequently, hydraulic fluid, which is shown by the dashed line in hydraulic passageway 950, can be pumped through the injector flow path 935*a*. Hydraulic fluid is injected into the hydraulic fluid passageway 950 from injector flow path 935*a*. The hydraulic fluid can be used to hydraulically control valve closure member 974. For example, hydraulic fluid can be used to force a mandrel 976 down to open valve closure member 974; and or force mandrel 976 up to allow valve closure member 974 to close.

Figure 10A:
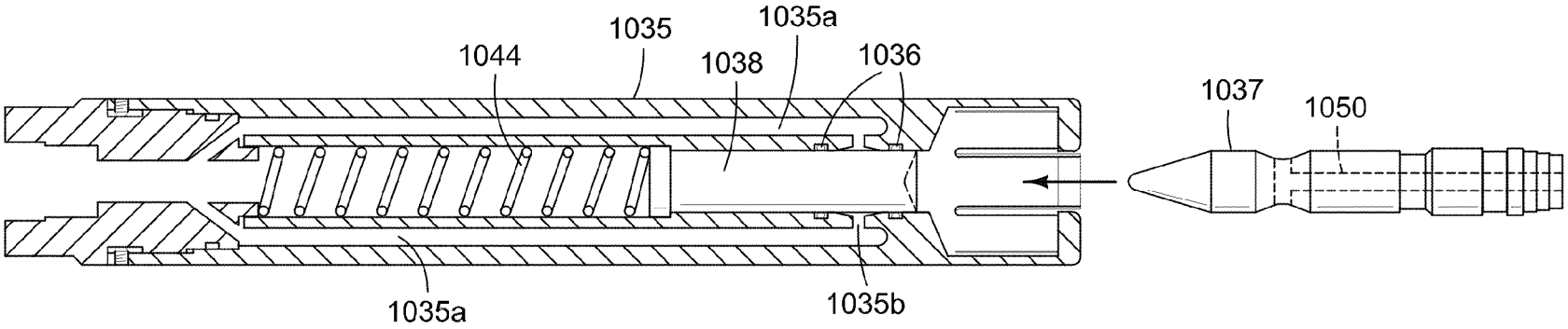
Figure 10B:
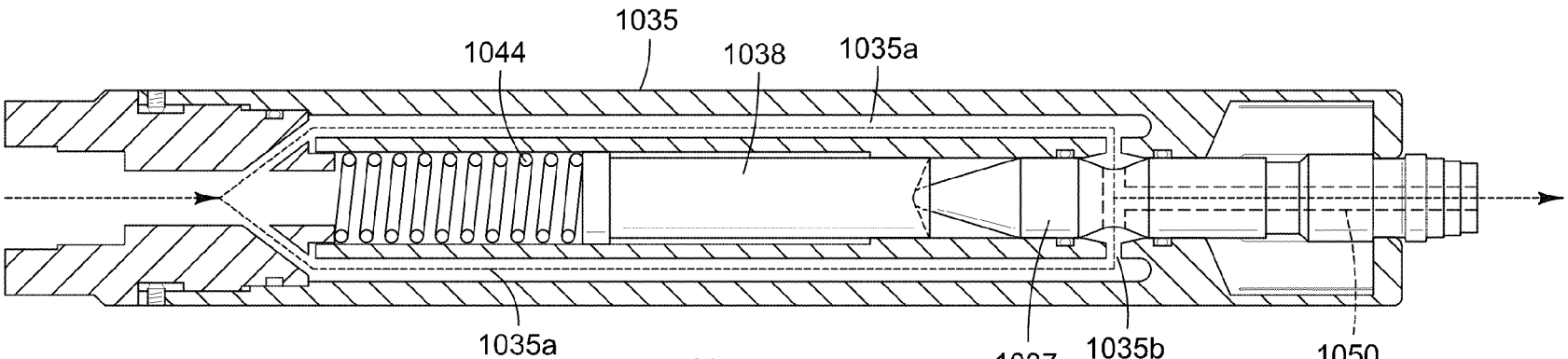
Figure 11:
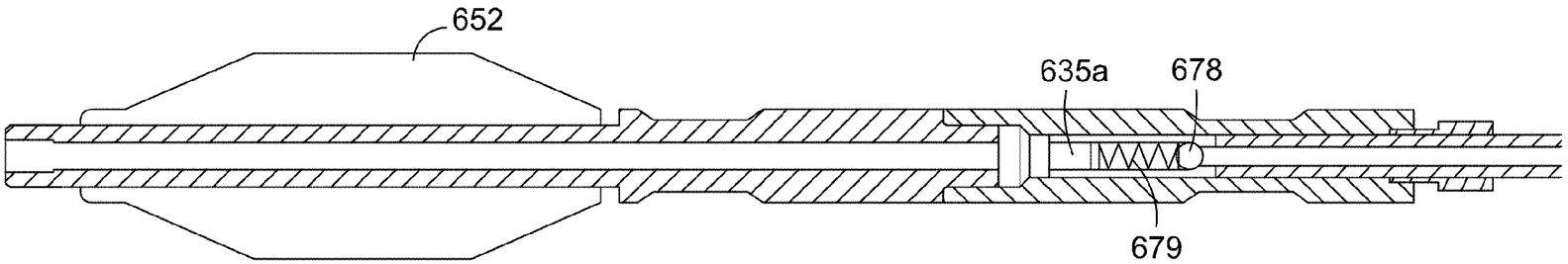
Figure 12:
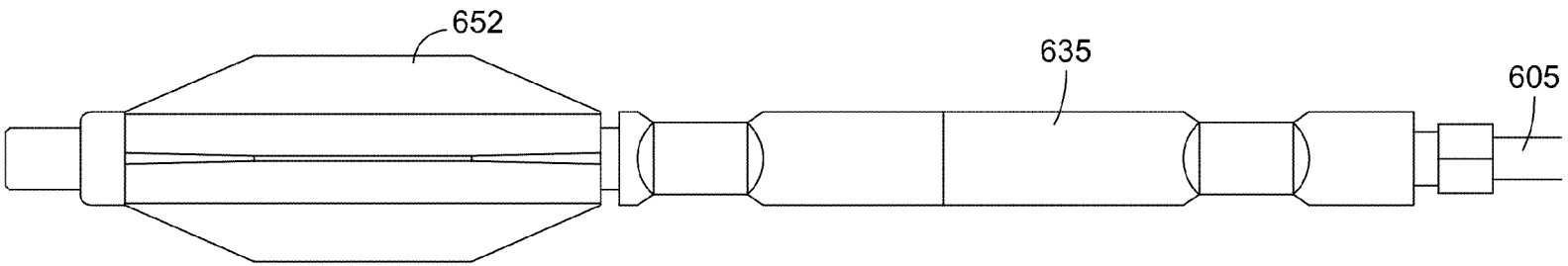

While each of the illustrated embodiments of FIGS. 6 to 7D and 9A to 9D shows the injector 635 to be a stinger (i.e., male injector) that is received by a female receptacle, in other embodiments the injector on the capillary tube can be a female injector designed to fit onto a male receptacle attached to a fluid passageway (e.g., bypass passageway or hydraulic fluid passageway). FIGS. 10A and 10B illustrate an embodiment of a male receptacle and female injector arrangement. Other than the female injector/male receptacle arrangement, the embodiment of FIGS. 10A and 10B is similar to the wellbore injection system 602 of FIG. 6.

FIG. 10A shows a female injector 1035 that is not yet engaged with male receptacle 1037, while FIG. 10B illustrates female injector 1035 engaged with male receptacle 1037. In FIG. 10A, a female injector 1035 can be attached to a capillary tube (not shown), similarly as discussed above for male injector 605 (See FIG. 6). In addition, female injector 1035 can be part of an injector assembly, including a set of wings (also not shown), which can be similar to the second set of wings 652 in the embodiment of FIG. 6.

Female injector 1035 can include an injector flow path 1035*a* and an injector flow path opening 1035*b*. An isolation mechanism 1038 can be employed for blocking the injector flow path opening 1035*b*. Isolation mechanism 1038 can be held in position by a biasing mechanism 1044, which can be, for example, a spring. Seals 1036 can aid in reducing leakage of fluids when either isolation mechanism 1038 is positioned to block injector flow path opening 1035*b*, or when male receptacle 1037 engages female injector 1035.

The male receptacle 1037 can be attached to the tubular housing of the wireline valve (not shown). In an embodiment, the male receptacle 1037 can be made to be removable from the tubular housing to provide for ease of manufacturing. Receptacle 1037 can include a bypass passageway 1050 that provides fluid communication with the wellbore downhole of the wireline valve, similar to the embodiment of FIG. 6. Alternatively, 1050 can be a hydraulic fluid passageway for allowing flow of hydraulic fluid to open and close the wireline valve, similarly as described in the embodiment of FIGS. 9A and 9B.

In operation, the capillary tube having the female injector 1035 attached thereto is passed down the wellbore and inserted onto the male receptacle. The downward motion of the female injector 1035 causes the male receptacle to force the isolation mechanism 1038 upward until the bypass passageway or hydraulic fluid passageway 1050 aligns with the injector flow path opening 1035*b*. In this manner, fluid communication is established between the capillary attached to injector 1035 and the bypass passageway or hydraulic fluid passageway 1050.

FIGS. 11 to 14 illustrate an embodiment of the present disclosure in which the disclosed injection system includes an added isolation mechanism. FIGS. 11 to 14 show a portion of the injection system of, for example, the embodiment of FIG. 6, from just below the second set of wings 652 to the capillary tube 605. As seen in the cross-sectional views of FIGS. 11 and 13, an additional isolation mechanism 678 is positioned in the injector flow path 635*a*. Isolation mechanism 678 provides an additional barrier against the undesired flow of wellbore fluids up the capillary tube to the surface, such as may occur if the isolation mechanism 638 is not working properly or is removed from the injection system.

Isolation mechanism 678 is chosen and positioned to reduce the likelihood of undesired flow of wellbore fluids up through the capillary tube to the surface, while still allowing fluid to pass through the valve from the surface down to the receptacle 637 (See FIG. 6). In an embodiment, isolation mechanism 678 can be a valve. Any suitable type of valve can be employed, such as, for example, an inline check valve that allows fluid to flow in a downhole direction but not an uphole direction. In an embodiment, a biasing mechanism 679 applies a force to position the valve 678 in a closed position in the absence of a downward flow of fluid through the capillary tube 605. A sufficient downward pressure from the fluid in capillary tube 605 can act to open the valve, thereby allowing fluid to flow from capillary tube 605 down through the injector flowpath 635*a*.

Figure 13:
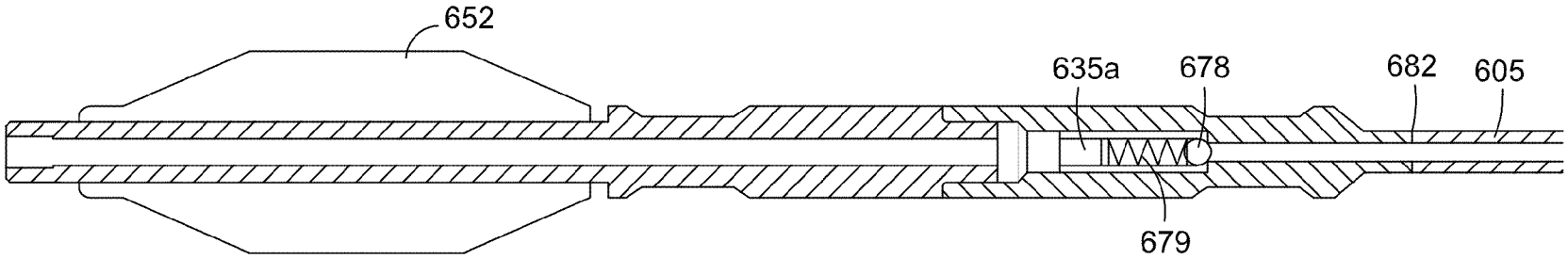
Figure 14:
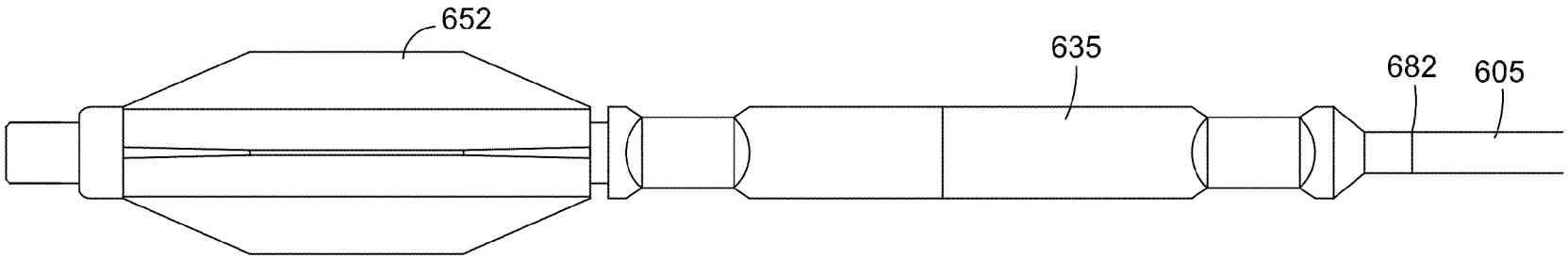

Capillary tube 605 can be attached to the injector 635 by any suitable manner, such as by screwing or latching the injector 635 onto the capillary tube 605. In another embodiment, as illustrated in FIGS. 13 and 14, the capillary tube 605 can be attached to injector 635 by a weld 682. Welding may provide the benefit of reducing the likelihood of leaks between the valve 678 and an operator at the surface.

FIGS. 15 and 16 illustrate an embodiment of yet another isolation mechanism 1592. Isolation mechanism 1592 can be employed with, for example, any of the male type injectors described previously herein, and in addition to the isolation mechanism 638 and/or the isolation mechanism 678, as also described herein.

Isolation mechanism 1592 can be a shuttle valve that effectively allows manipulation of the injector flow path 635*a* to open or close the valve. For example, the isolation mechanism 1592 can comprise an injector dart 1588 that slideably engages an injector body 1586, as illustrated in FIG. 15. Injector dart 1588 is capable of moving in a longitudinal direction within the injector body 1586. Injector dart 1588 comprises a first section of the injector flow path 1535*a*. Injector body 1586 comprises a second section of the injector flow path 1535*c*. Seals 1536 and 1584 can be positioned to reduce the risk of fluid leaking into or out of the first section of injector flow path 1535*a* and the second section of injector flow path 1535*c*.

When the injector 1535 is being run in, the injector dart 1588 can be slideably positioned relative to the injector body 1586 so that that first section of the injector flow path 1535*a* is not aligned with the second section of the injector flow path 1535*c*, so as to provide a barrier to fluid flow through the injector flow path, as illustrated in FIG. 15. When the injector 1535 is landed, impact with the receptacle 637 (e.g., see FIG. 7D) can force dart 1588 up into the interior of the injector body 1586. In this manner, injector dart 1588 can be slideably positioned relative to the injector body 1586 so as to align the first section of the injector flow path 1535*a* and the second section of the injector flow path 1535*c*. This can allow fluid communication between the injector flow path 1535*a* and, for example, the bypass passageway 650 in the embodiment of FIG. 6 or the hydraulic passageway 950 in the embodiment of FIG. 9. FIG. 15B illustrates injector 1535 with the first section of the injector flow path 1535*a* aligned with the second section of the injector flow path 1535*c*.

Similarly as described above for the embodiment of FIGS. 7A to 7D, a second retaining mechanism 646 can be employed for holding the injector 1535 substantially in place relative to the receptacle 637. For example, one or more collet fingers 649 (as shown in FIG. 7D) can attach to the shoulder profile 1547 of dart 1588. When the injector 1535 is retrieved from receptacle 637, collet fingers 649 can hold on sufficiently to shift the dart 1588 out of injector body 1586, causing the first section of the injector flowpath 1535*a* and the second section of the injector flowpath 1535*c* to come out of alignment and thereby block injector flowpath 1535*a*. This can protect against undesirable exposure of the injector flow path 1535*a* from well bore pressures.

Numerous embodiments and alternatives thereof have been disclosed. While the above disclosure includes the best mode belief in carrying out the embodiments of the present application as contemplated by the inventors, not all possible alternatives have been disclosed. For that reason, the scope and limitation of the present invention is not to be restricted to the above disclosure, but is instead to be defined and construed by the appended claims.

What is claimed is:

1. A wellbore injection system, comprising:

a capillary fluid flow path positioned in a subsurface wellbore so as to allow fluid communication through the wellbore, the wellbore having a wellbore pressure;

a receptacle in fluid communication with a second fluid flow path that is positioned below the capillary fluid flow path in the wellbore;

an injector attached to a distal end of the capillary fluid flow path, the injector comprising an injector flow path, wherein the injector is removably attached to the receptacle to provide fluid communication between the capillary fluid flow path and the second fluid flow path through the injector flow path;

and an isolation mechanism adapted to isolate the capillary fluid flow path from the wellbore pressure when the injector is not attached to the receptacle.

2. The system of claim 1, further comprising a biasing mechanism proximate the isolation mechanism, the biasing mechanism applying a first force to the isolation mechanism that acts to automatically isolate the capillary fluid flow path from the wellbore pressure when the injector is not attached to the receptacle.

3. The system of claim 2, wherein the isolation mechanism is a tubular member slideably attached to the injector so that the injector can move back and forth inside of the tubular member between a first position relative to the tubular member in which the tubular member blocks the injector flow path to isolate the capillary fluid flow path from the wellbore pressure and a second position relative to the tubular member in which the tubular member does not block the injector flow path.

4. The system of claim 3, wherein the biasing mechanism is a spring, the spring applying a force to the tubular member that tends to move the tubular member into the first position.

5. The system of claim 3, wherein the injector comprises one or more seals positioned proximate an injector flow path opening for providing a seal between the injector and the tubular member when the injector is in the first position.

6. The system of claim 1, further comprising a first retaining mechanism for selectively holding the isolation mechanism substantially in place relative to the wellbore, the retaining mechanism allowing the injector to move relative to the isolation mechanism.

7. The system of claim 6, wherein the first retaining mechanism comprises a first profile flexibly mounted on the isolation mechanism, the first profile being adapted to engage a second profile attached to the wellbore so as to selectively hold the isolation mechanism substantially in place relative to the wellbore.

8. The system of claim 7, wherein the first profile is flexible mounted on one or more wings attached to the isolation mechanism.

9. The system of claim 6, further comprising a second retaining mechanism for holding the injector substantially in place relative to the receptacle.

10. The system of claim 9, wherein the second retaining mechanism comprises a profile in the injector that is adapted to engage one or more collet fingers attached to the receptacle.

11. The system of claim 1, further comprising a wireline retrievable surface controlled subsurface safety valve that is positioned below the receptacle in the wellbore, wherein the second fluid flow path is a bypass passageway for directing fluid below the wireline retrievable surface controlled subsurface safety valve.

12. The system of claim 1, further comprising a wireline retrievable surface controlled subsurface safety valve that is positioned below the receptacle in the wellbore, wherein the second fluid flow path is a hydraulic fluid passageway for directing hydraulic fluid to control operation of the wireline retrievable surface controlled subsurface safety valve.

13. The system of claim 1, wherein the injector is a male injector and the receptacle is a female injector designed to receive the male injector.

14. The system of claim 1, wherein the injector is a female injector and the receptacle is a male injector designed to receive the female injector.

15. The system of claim 1, further comprising a second isolation mechanism adapted to isolate the capillary fluid flow path from wellbore pressures when the injector is not attached to the receptacle.

16. The system of claim 15, wherein the second isolation mechanism is a valve positioned in the injector flow path.

17. The system of claim 1, wherein the isolation mechanism is attached to the injector.

18. An injector isolation system for use in a wellbore, the wellbore comprising a capillary fluid flow path providing fluid communication through the wellbore, and a receptacle in fluid communication with a second fluid flow path that is positioned below the capillary fluid flow path in the wellbore, the injector isolation system comprising:

an injector adapted to be attached to a distal end of the capillary fluid flow path, the injector comprising an injector flow path through which fluid can pass into and out of the injector, wherein the injector is removably attached to the receptacle to provide fluid communication between the capillary fluid flow path and the second fluid flow path through the injector flow path; and an isolation mechanism adapted to isolate the capillary fluid flow path from the wellbore pressure when the injector is not attached to the receptacle.

19. The system of claim 18, further comprising a biasing mechanism proximate the isolation mechanism, the biasing mechanism applying a first force to the isolation mechanism that acts to automatically isolate the capillary fluid flow path from the wellbore pressure when the injector is not attached to the receptacle.

20. The system of claim 19, wherein the isolation mechanism is a tubular member slideably attached to the injector so that the injector can move back and forth inside of the tubular member between a first position relative to the tubular member in which the tubular member blocks the injector flow path to isolate the capillary fluid flow path from the wellbore pressure and a second position relative to the tubular member in which the tubular member does not block the injector flow path.

21. The system of claim 20, wherein the biasing mechanism is a spring, the spring applying a force to the tubular member that tends to move the tubular member into the first position.

22. The system of claim 20, wherein the injector comprises one or more seals positioned proximate an injector flow path opening for providing a seal between the injector and the tubular member when the injector is in the first position.

23. The system of claim 18, further comprising a first retaining mechanism for holding the isolation mechanism substantially in place relative to the wellbore, the retaining mechanism allowing the injector to move relative to the isolation mechanism.

24. The system of claim 23, wherein the first retaining mechanism comprises a first profile flexibly mounted on the isolation mechanism, the first profile being adapted to engage a second profile attached to the wellbore so as to hold the isolation mechanism substantially in place relative to the wellbore.

25. The system of claim 24, wherein the first profile is flexible mounted on one or more wings attached to the isolation mechanism.

26. The system of claim 23, further comprising a second retaining mechanism for holding the injector substantially in place relative to the receptacle.

27. The system of claim 26, wherein the second retaining mechanism comprises a profile in the injector that is adapted to engage one or more collet fingers attached to the receptacle.

28. The system of claim 18, wherein the injector comprises a shuttle valve.

29. The system of claim 28, wherein the injector comprises a injector body and an injector dart that slideably engages the injector body so as to be capable of moving in a longitudinal direction within the injector body, the injector body comprising a first section of the injector flow path and the injector dart comprising a second section of the injector flow path, wherein the injector dart can be slideably positioned relative to the injector body so as to align the second section of the injector flow path and the first section of the injector flow path to allow fluid communication between the first section of the injector flow path and the second fluid flow path positioned below the capillary fluid flow path in the wellbore, and further wherein the injector dart can be slideably positioned relative to the injector body so that the second section of the injector flow path is not aligned with the first section of the injector flow path to provide a barrier to fluid flow through the first section of the injector flow path.

30. A kit for enhancing a wireline retrievable surface controlled subsurface safety valve to inject a production-enhancing fluid while maintaining operability of the wireline retrievable surface controlled subsurface safety valve comprising:

an upper adapter connected to a locking mandrel and adapted to connect to a proximal end of the wireline retrievable surface controlled subsurface safety valve;

a lower adapter adapted to connect to a distal end of the wireline retrievable surface controlled subsurface safety valve;

a bypass passageway extending between the upper and the lower adapters allowing fluid communication around the wireline retrievable surface controlled subsurface safety valve;

a receptacle of the upper adapter adapted to removably receive an injector disposed on a distal end of an upper capillary tube, the receptacle in communication with the bypass passageway; and an isolation mechanism adapted to isolate the capillary tube from a wellbore pressure when the injector is not received by the receptacle.

31. The kit of claim 30, further comprising a biasing mechanism proximate the isolation mechanism, the biasing mechanism applying a first force to the isolation mechanism that acts to automatically isolate the capillary fluid flow path from the wellbore pressure when the injector is not attached to the receptacle.

32. The kit of claim 31, wherein the isolation mechanism is a tubular member slideably attached to the injector so that the injector can move back and forth inside of the tubular member between a first position relative to the tubular member in which the tubular member blocks the injector flow path to isolate the capillary fluid flow path from the wellbore pressure and a second position relative to the tubular member in which the tubular member does not block the injector flow path.

33. The kit of claim 30, further comprising a first retaining mechanism for selectively holding the isolation mechanism substantially in place relative to the wellbore, the retaining mechanism allowing the injector to move relative to the isolation mechanism.

34. The kit of claim 33, wherein the first retaining mechanism comprises a first profile flexibly mounted on the isolation mechanism, the first profile being adapted to engage a second profile attached to the wellbore so as to selectively hold the isolation mechanism substantially in place relative to the wellbore.

35. The kit of claim 34, wherein the first profile is flexible mounted on one or more wings attached to the isolation mechanism.

36. The kit of claim 35, further comprising a second retaining mechanism for holding the injector substantially in place relative to the receptacle.

* * * * *